US012295471B2

(12) United States Patent
Armstrong

(10) Patent No.: US 12,295,471 B2
(45) **Date of Patent: *May 13, 2025**

(54) PROTECTIVE CASE FOR A COMPUTING DEVICE

(71) Applicant: Urban Armor Gear, LLC, Laguna Niguel, CA (US)

(72) Inventor: Steven Armstrong, Laguna Niguel, CA (US)

(73) Assignee: Urban Armor Gear, LLC, Laguna Niguel, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/144,640

(22) Filed: May 8, 2023

(65) Prior Publication Data

US 2023/0270219 A1 Aug. 31, 2023

Related U.S. Application Data

(63) Continuation of application No. 17/105,197, filed on Nov. 25, 2020, now Pat. No. 11,653,733, which is a (Continued)

(51) Int. Cl.

| | |
|---|---|
| ***A45C 13/00*** | (2006.01) |
| ***A45C 11/00*** | (2006.01) |
| ***A45C 13/36*** | (2006.01) |

(52) U.S. Cl.

CPC ..... *A45C 13/002* (2013.01); *A45C 11/00* (2013.01); *A45C 13/001* (2013.01); (Continued)

(58) Field of Classification Search

CPC ..... A45C 11/00; A45C 13/002; A45C 13/001; A45C 13/005; A45C 13/36; A45C 2011/002; A45C 2011/003 (Continued)

(56) References Cited

U.S. PATENT DOCUMENTS

| | | | |
|---|---|---|---|
| 5,263,423 | A | 11/1993 | Anderson |
| 5,706,168 | A | 1/1998 | Erler et al. |

(Continued)

FOREIGN PATENT DOCUMENTS

| | | | |
|---|---|---|---|
| CN | 201047923 | Y | 4/2008 |

*Primary Examiner* — Steven A. Reynolds
(74) *Attorney, Agent, or Firm* — Neal, Gerber & Eisenberg, LLP

(57) ABSTRACT

A composite case for a computing device comprising a first portion to protect and detachably connect to a display portion. The first portion may have perimetral fasteners disposed on its edges. A second portion is for protecting and detachably connecting to an input device portion of the computing device. The second portion may have perimetral fasteners disposed on its edges. The display and input device portions can be detachably connected to each other through a multi-pivot hinge unit operable to rotate about one or more computing device axes defined between the display and input device portions to move the computing device between open and closed states. A hinge cover portion can be connected to the first portion operable to detachably receive and surround the multi-pivot hinge of the computing device. A protective shell can be formed between first and second portions.

17 Claims, 15 Drawing Sheets

Related U.S. Application Data continuation of application No. 15/335,379, filed on Oct. 26, 2016, now Pat. No. 10,849,398.

(52) U.S. Cl.
CPC ..... *A45C 13/005* (2013.01); *A45C 13/36* (2013.01); *A45C 11/002* (2025.01); *A45C 11/003* (2025.01)

(58) Field of Classification Search
USPC ..... 206/320; 361/679.27, 679.55
See application file for complete search history.

(56) References Cited

U.S. PATENT DOCUMENTS 6,262,886 B1 7/2001 DiFonzo et al.
6,267,236 B1 * 7/2001 Seok ..... A45C 13/002 206/320
7,007,912 B1 3/2006 Giuliani et al.
7,643,274 B2 * 1/2010 Bekele ..... G06F 1/1662 361/679.55
7,672,117 B1 3/2010 Gary et al.
7,886,903 B1 2/2011 Wurzelbacher
10,849,398 B2 * 12/2020 Armstrong ..... A45C 13/001
11,653,733 B2 * 5/2023 Armstrong ..... A45C 13/001 224/241
2003/0217940 A1 11/2003 Russell et al.
2004/0217027 A1 11/2004 Harris et al.
2006/0060485 A1 3/2006 Picot et al.
2006/0226040 A1 * 10/2006 Medina ..... G06F 1/1616 361/679.55
2008/0308437 A1 12/2008 Lin
2009/0229497 A1 9/2009 Persico et al.
2010/0044259 A1 * 2/2010 Wang ..... A45C 13/30 190/117
2010/0314266 A1 * 12/2010 Hartmann ..... G02B 6/445 206/225
2011/0147398 A1 6/2011 Ahee
2013/0092562 A1 4/2013 Wyner et al.
2013/0214661 A1 * 8/2013 McBroom ..... G06F 1/166 312/325
2017/0023985 A1 * 1/2017 Xin ..... G06F 1/1681
2017/0023986 A1 1/2017 Xin et al.

* cited by examiner

PROTECTIVE CASE FOR A COMPUTING DEVICE

PRIORITY CLAIM

This application is a continuation of, claims priority to and the benefit of U.S. patent application Ser. No. 17/105,197, filed on Nov. 25, 2020, which is a continuation of, claims priority to and the benefit of U.S. patent application Ser. No. 15/335,379, filed on Oct. 26, 2016, now U.S. Pat. No. 10,849,398 the entire disclosure of which are each incorporated herein by reference.

FIELD

This disclosure relates generally to protective cases for computing devices and more particularly, protective cases for computing devices such as, tablets, laptops, and smart phones.

BACKGROUND

With increasing regularity, protective cases are being constructed for a variety of computing devices such as smart phones, tablets, laptops, and/or other portable computing devices. Their respective designs vary, ranging between degrees of protection as well as facilitating use of the computing device in a more protected environment.

Cases have been known to be constructed from molding using silicon or thermoplastic polyurethane rubber that provides some basic protection against drops and scratches. Other case designs have been constructed from relatively stiffer injected plastics such as polycarbonate.

The design and construction of the known cases therefore vary depending on the desired amount of protection, costs, and consideration for certain materials and mounting schemes balanced with features that facilitate performance of the computing device itself. For example, certain material may provide basic structural protection, be relatively cheap, but this material may induce too much friction (e.g. grip) to the user that interferes with easy attachment of the case with the device or grip with other articles such as parts of the user's body or other objects foreign to the case.

In addition to material selection, cases can suffer from being too bulky and difficult to stow away. It is also known that materials for certain cases can degrade over time thereby diminishing protective capabilities of the case as well as loosening its attachment with the computing device. Aesthetically, a worn case also diminishes the overall impression of the case and the attached computing device. Such cases can also have reduced bulk versus their rubber counterparts. Plastic injected mold cases can suffer from passing on relatively high material stresses to the computing device itself due to the differing elasticity and cushioning. For computing devices with sensitive displays or input devices, such protective devices may therefore may not be desirous. Certain cases also decrease the ability of a device positioned within them to expel heat by virtue of the materials chosen or the coverage over vents or other heated areas of the device.

Certain hybrid combinations have therefore been designed to combine each approach with the softer, cushion portions being placed in communication with the computing device whereas the exterior portion being constructed from the less bulky, injected plastic.

Yet, even with these hybrid solutions, stress tests to the computing devices caused by normal use through drops or collisions can lead to device damage and case separation. In turn, the user may have to fix the device, buy a new one, and/or re-assemble the case with the computing device. Furthermore, many cases fail to completely protect or envelope the associated computing device which unnecessarily risks structural harm to the computing device. Therefore, a need exists to resolve these and other problems in the art.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In some embodiments, a composite case for a computing device is disclosed having a first portion and second portion. The first portion is operable to protect and detachably connect to a display portion of the computing device, the first portion having one or more perimetral fasteners disposed on edges of the first portion. The second portion is operable to protect and detachably connect to an input device portion of the computing device. The second portion may have one or more perimetral fasteners disposed on edges of the second portion. The display and input device portions may be detachably connected to each other through a multi-pivot hinge unit. The multi-pivot hinge unit may be operable to rotate about one or more computing device axes defined between the display and input device portions to move the computing device between open and closed states. A hinge cover portion can be connected to the first portion to detachably receive and surround the multi-pivot hinge of the computing device. A protective shell may be formed between the first and second portions when the first and second portions are joined at the hinge cover portion. One or more perimetral fasteners of the first and second portions opposite the hinge cover portion can be secured with each other in a closed position.

In certain embodiments, the first portion includes a resilient portion dimensioned to detachably receive perimetral edges of the display portion and a rigid portion detachably connected to a rear surface of the display portion of the computing device, the rigid portion being impact resistant and dimensioned to shield the rear surface of the display portion. In certain embodiments, one or more impact resistant corners are formed with the perimetral edge and/or the rear surface.

Also in certain embodiments, the hinge cover portion can include an elongate hemispheric chamber for receiving the hinge cover of the computing device. A series of elongated channels can be extended along the chamber between lateral edges of the second portion. A plurality of fastener tabs can be extended from a lower edge of the chamber to upper and lower surfaces of the second portion. The second portion can be substantially rigid and the hinge cover can be resilient. The second portion can include a plurality of receivers spaced a predetermined distance apart and formed from cutouts of the second portion along a rear edge of the second portion. The cutouts associated with the receivers of the second portion can render flexible the rear edge of the second portion.

in other embodiments, the hinge cover portion can include a rigid elongate hemispheric chamber extended between lateral edges of the second portion of the case. The rigid elongate hemispheric chamber can be axially aligned with and receive the hinge cover of the computing device. A gap may be provided for moving between open and dosed states between the multi-pivot hinge of the computing device and the chamber when the hinge cover portion is secured to the multi-pivot hinge. The gap may depend on the amount of rotation desired between opened and closed states, number, size, and/or shape of hinges of the multi-pivot hinge unit. A resilient fastener tab can be extended from a lower portion of the chamber for connecting the hinge cover portion to a recess on a lower surface of the second portion of the case. The tab can be extended between opposite lateral edges of the second portion and may be substantially planar to the recess on the lower surface of the second portion. The resilient fastener tab can include a first portion substantially surrounding an outer surface of the chamber and a second portion pivotally attached to the first portion along an edge axially aligned with the chamber. The second portion can be operable to be substantially planar and connected to the recess of the second portion of the case. The first and second portion of the tab can be formed from a shared outer grip inducing surface.

In some embodiments, a retention band can be extended from opposite ends of the chamber of the hinge cover portion. The retention band can be operable to securely retain the multi-pivot hinge of the computing device with the chamber. The retention band can be movable and/or flexible (e.g. be an elastic bungee, a band such as an elastic, an adjustable strap, a band containing linked or hinged subunits or portions, etc.). The hinge cover portion can include a plurality of bulkheads or structural members normal to the longitudinal axis of the rigid hemispheric chamber and extended along the chamber between lateral edges of the second portion. The second portion can be substantially rigid and the hinge cover can be substantially resilient. The recess of the second portion can render flexible the rear edge of the second portion.

In other embodiments, the hinge cover portion may be formed from multiple individual pieces and the retention band can be attached to both sides of portions of the case or attached onto either or both sides of the case or the hinge unit of the computing device.

In some embodiments, the perimetral fasteners of the first portion can include a forward edge fastener defined by an inwardly facing lip operable to detachably secure to an upper edge of the display portion opposite the hinge cover portion. A plurality of lateral edge fastener tabs can also be included that extend downward from opposing lateral edges of the first portion, each lateral edge fastener tab being operable to flex outwardly and securely engage with a corresponding receiver disposed on a lateral edge of the second portion. The corresponding receiver of the second portion can extend outwardly from the respective lateral edge of the second portion and may be capable of being received by a recess of the corresponding lateral edge fastener tab of the first portion. The lateral edge fastener tab can be resilient and the corresponding receiver of the second portion can be rigid. An axis of rotation of the hinge cover portion can be co-extensive to a hinge axis of the multi-pivot hinge unit. In certain embodiments, the multi-pivot hinge unit is an armadillo hinge assembly. Additionally, the first portion can provide impact resistance to the display portion regardless of whether the second portion is detachably connected to the input device portion or the first portion (e.g., if the display portion is a tablet and is not connected to the hinge of the computing device, the first portion, or the input device portion). Accordingly, the first and second portions may not be directly attached at all, they may be directly attached irrespective of whether input and display portions are connected, or the first and second portions may be attached to the other when the input device and display portions are connected via the multi-pivot hinge unit.

The first portion can include one or a plurality of impact resistant portions or resilient portions. Perimetral edges of the first portion can extend away from a rear support surface and terminate in a flexible inwardly extending lip operable to flex outwards and securely retain the display portion of the computing device. The lip can be thicker than the portion of the perimetral edge extending away from the rear support surface.

In other embodiments, a method of protecting a computing device is disclosed. The computing device can have a display portion and an input device portion detachably and pivotally connected through a multi-pivot hinge unit operable to rotate about one or more computing device axes defined between the display and input device portions to move the computing device between open and closed states. The method can include: attaching a leading edge and/or lateral edges of the display portion with one or more perimetral fasteners a first portion of a composite case; the first portion comprising a substantially rigid rear surface and resilient perimetral edges; aligning the display portion planar with the rear surface of the first portion of the composite case; attaching edges of the input device portion with one or more perimetral fasteners of a second portion of the composite case, the second portion comprising a substantially rigid rear surface: aligning the input device portion planar with a rear surface of the second portion; and positioning the multi-pivot hinge unit in a hinge cover portion of the composite case, the hinge cover portion having a rigid elongate hemispheric chamber in which the multi-pivot hinge is movable between opened and closed positions, the hinge cover portion being connected to a rear edge of the first portion of the composite case.

The method may also include forming a protective shell about the computing device between the first and second portions when the first and second portions are joined at the hinge cover portion and one or more of perimetral fasteners of the first and second portions opposite the hinge cover portion are secured with each other in a closed position.

The method can also include positioning the hinge cover of the computing device within an elongate hemispheric chamber the hinge cover portion, the hinge cover portion including a series of elongated channels extended along the chamber between lateral edges of the second portion; and a plurality of fastener tabs extended from a lower edge of the chamber to upper and lower surfaces of the second portion; the second portion being substantially rigid and the hinge cover being substantially resilient.

The method can also include positioning the hinge cover of the computing device within a rigid elongate hemispheric chamber extended between lateral edges of the second portion of the case, the rigid elongate hemispheric chamber being operably to axially align with and to receive the hinge cover of the computing device, the hinge cover portion comprising: a gap for moving between open and closed states between the multi-pivot hinge of the computing device and the chamber when the hinge cover portion is secured to the multi-pivot hinge; a resilient fastener tab extended from a lower portion of the chamber for connecting the hinge cover portion to a recess on a lower surface of the second portion of the case, the tab extended between opposite lateral edges of the second portion and being substantially planar to the recess on the lower surface of the second portion.

A variety of methods and systems of utilizing and assembling the disclosed case is also contemplated in a variety of situations and environments. To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
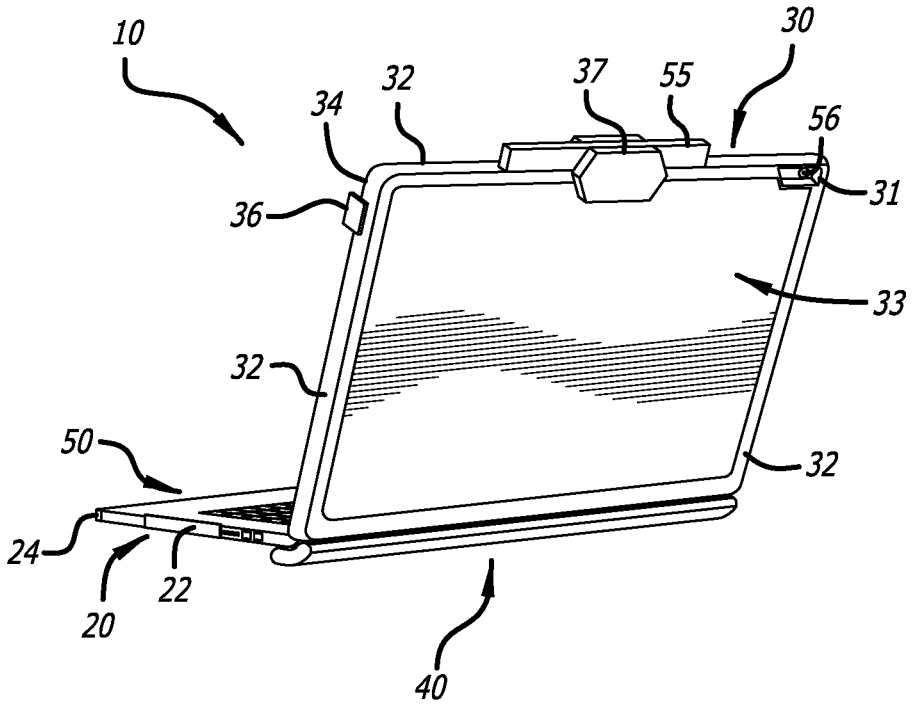
FIG. 1 is a rear perspective view of an exemplary view of the herein described protective case for a computing device, wherein the case and computing device are in an opened state.

The features of the presently disclosed solution may be economically molded or assembled by using one or more distinct parts and associated components which, may be assembled together for removable or integral application with a known or to-be-designed computing device case in an economical manner, wherein the features of the present disclosure may form the herein disclosed servicing apparatus regardless of the particular form. Unless defined otherwise, all terms of art, notations and other scientific terms or terminology used herein have the same meaning as is commonly understood by one of ordinary skill in the art to which this disclosure belongs.

Terms with commonly understood meanings may be defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, application, published applications and other publications that are herein incorporated by reference, the definition set forth in this section prevails over the definition that is incorporated herein by reference.

As used herein, "a" or "an" means "at least one" or "one or more." As used herein, the term "user", "subject", "end-user" or the like is not limited to a specific entity or person. For example, the term "user" may refer to a person who uses the systems and methods described herein, and frequently may be a technician. However, this term is not limited to end users or technicians and thus encompasses a variety of persons who can use the disclosed systems and methods.

The disclosed solution can now be better understood turning to the following detailed description. It is to be expressly understood that the illustrated embodiments are set forth as examples and not by way of limitations on the embodiments as ultimately defined in the claims. An embodiment in accordance with the present disclosure provides a cover for a computing device such as a laptop, a tablet or any other portable computing device. The cover can be made of multiple parts, integrally formed therewith or detachable.

It is understood that "computing device" can mean any computer such as a laptop, a tablet computing device, a mobile device such as a cellular phone, a mobile phone, a smart phone, or the like.

"Shield" as used herein with the disclosed case can mean to protect, wrap around, or envelope a corresponding computing device in a manner that conceals the computing device from injuries during a drop or accident such as by impact or collision.

"Impact resistant" or "impact resistance" as it relates to the herein disclosed case features can mean any feature designed to withstand relatively high applied forces or related shock. Accordingly, features or materials described herein as providing impact resistance or being impact resistant utilize material properties and/or structural design of the case directed towards mitigating the effects of expected events in the life-cycle of the case and corresponding computing device that incur impact (e.g. drops, collisions, accidents, etc).

The herein disclosed solution described a case capable of exhibiting the shock resistant benefits of a case with elastomeric edges or outer portions combined with the consumer usability benefits of a resilient outer case such as relatively stronger plastics. The herein described solution may also be a composite case with some combination of one or more elastic materials with one or more harder, resilient materials, such as injection molded plastic and/or rubber, in a way that forms a permanent bond therebetween resulting in a protective system that sufficiently securely retains and protects a computing device in most operating conditions including, but not limited to, the standards set forth by MIL-STD 810G, 506.6 VI. The herein disclosed solution also contemplates a composite case in which the geometric shape of the constituent components maximizes overall structural strength and impact resistance while minimizing material weight and size.

For simplicity and illustration purposes only, the presently disclosed cases 10, 110 are depicted for use with a laptop and/or tablet device though the solution is not so limited and could be used with other referenced computing devices as understood in the context of this disclosure and other numerous consumer electronic devices, wherein cases 10, 110 would employ similar details, features and benefits.

The herein disclosed case offers solutions to protect and shield computing devices employing multi-axis or multi-pivot hinges to rotatably secure input and display portions of said computing device. It is understood that multi-axis or multi-pivot hinges can incorporate a plurality of discrete hinge units, with respective rotational axes, and can move between a plurality of opened and closed positions. In certain embodiments, some or all of the discrete hinges of the multi-pivot hinge unit can include a rotational limiter to limit degree of rotation of the respective hinge relative to an adjoining discrete hinge.

Turning to the figures, FIGS. 1-4 show forward and rear perspective views of the herein disclosed case 10 assembled with an exemplary computing device 50. Computing device 50 includes an input portion 54 (e.g. a keyboard) and a display portion 58. Portions 54 and 58 may be detachably interconnected through a multi-pivot hinge 59. Preferably, hinge 59 is disposed at the trailing edge of portion 54 and is an armadillo hinge assembly. Multi-pivot hinges that can be used with device 50 are designed to rotatably secure separate portions of device 50, such as input 54 and display 58 portions.

Figure 2:
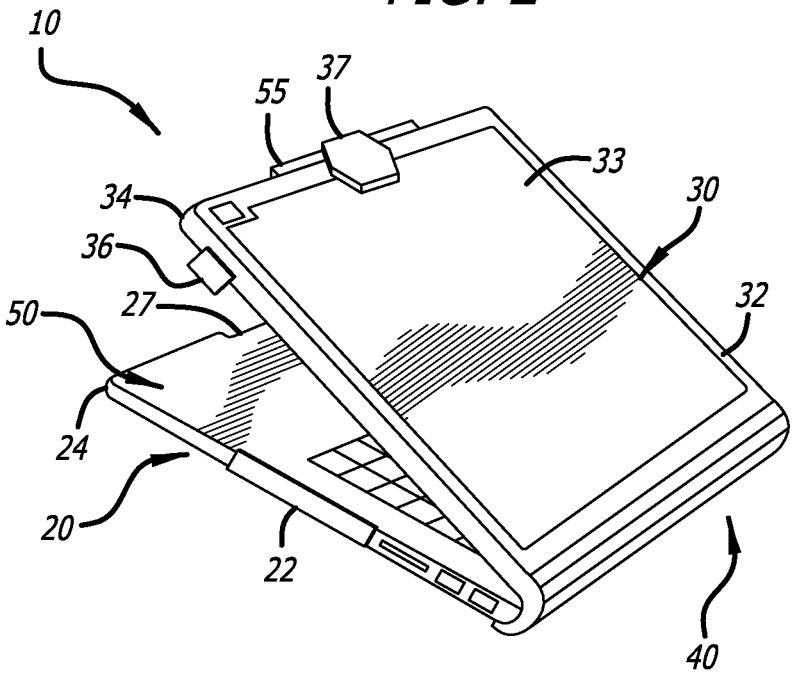
FIG. 2 is a rear perspective view of the case of FIG. 1, wherein the case is being collapsed with an exemplary computing device.
Figure 3:
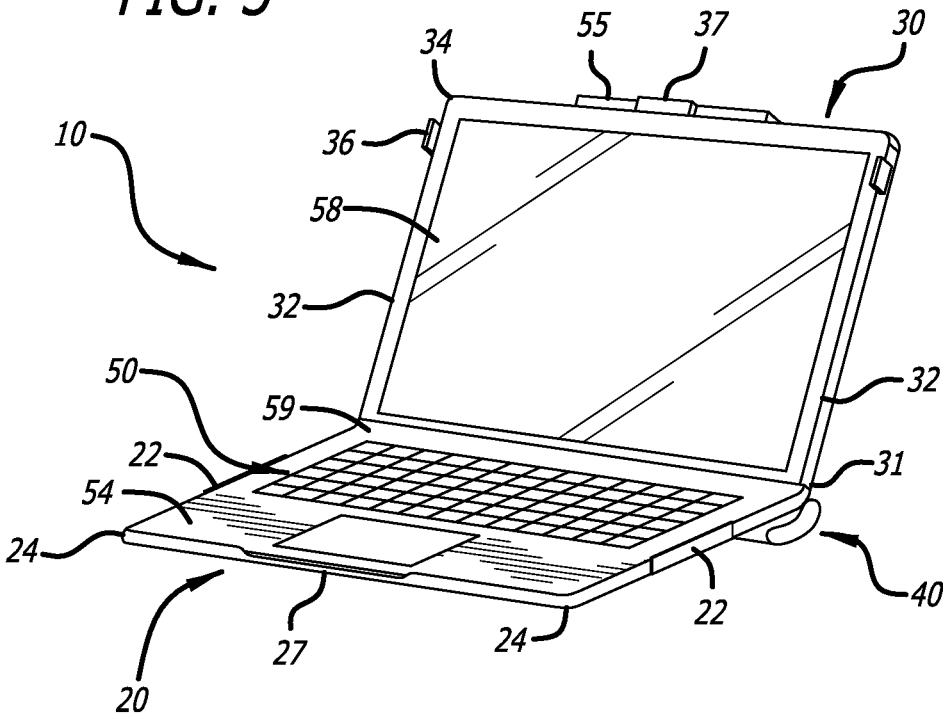
FIG. 3 is forward perspective view the case of FIG. 1 assembled with an exemplary computing device.
Figure 4:
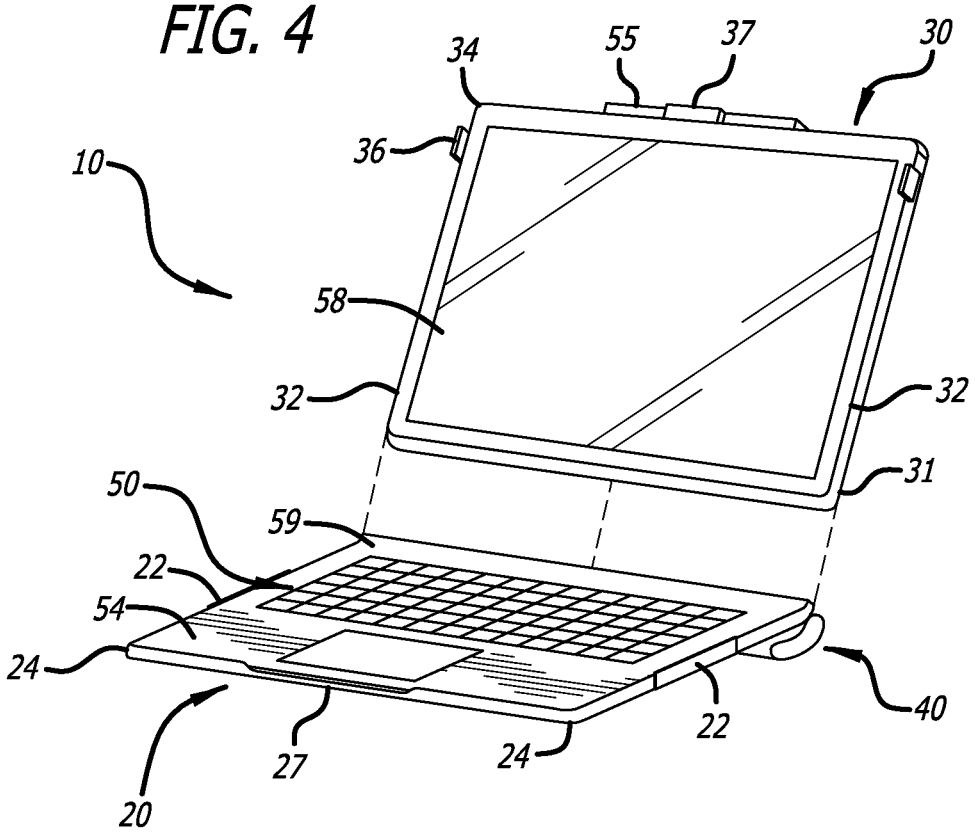
FIG. 4 is a forward perspective view of the case and device of FIG. 3, wherein the screen and keyboard portions are in an exploded state.

FIG. 1 specifically depicts a perspective view of a case 10 assembled with computing device 50 in an opened state. FIG. 2 depicts a similar embodiment but instead case 10 is now in the process of being collapsed to form a shield around computing device 50 as discussed more particularly below. FIG. 3 depicts a forward perspective view of case 10 assembled with device 50 in an opened state, wherein portions 54 and 58 can be seen assembled with the other through hinge 59. FIG. 4 depicts case 10 and device 50 of FIG. 3 but in an exploded state, wherein portions 58 and 30 are assembled with each other but are exploded from hinge 59. Case 10 may be operable to securely retain and shield computing device 50 and preferably may be constructed from a base portion 20 and an upright portion 30. Portion 20 may be designed to receive and shield an input device 54 whereas portion 30 may be designed to receive and shield display portion 58.

Portion 20 may also include a hinge cover portion 40 attached to a trailing edge of base portion 20. Portion 40 may be designed to receive hinge 59 of device 50 when device 50 is in an assembled state (portions 54 and 58 connected to each other across hinge 59) or when portions 54 and 58 are mechanically disconnected from the other.

Portion 30 may be constructed from a relatively resilient material along its perimetral edge portion 32. Edge portion 32 may be substantially or partially flexible in one or more predetermined areas. For example certain areas of portion 32 immediately adjacent or nearby corners 34 may be relatively resilient or stiff whereas areas 33 disposed in a central portion closer away from corners 34 may be more rigid so that portion 32 can conform to portion 58 as needed. Corners 34 in turn may be reinforced with one or more impact resistant materials and/or designs to withstand and shield portion 58 and device 50 during collision, drop or otherwise accidental conduct. Notably, when portion 30 is engaged with display portion 58, in certain embodiments it provides impact resistance to display portion 58 regardless of whether display portion is engaged with input portion 54. For example, display portion 58 may be removed and used as a tablet apart from the input portion 54, while it maintains impact resistance while it is engaged with portion 30. Often, both portions 54, 58 maintain impact resistance as portions 20 and 30 remain engaged with them even as the device is used in a tablet mode. Opposite corners 34 on the lower, trailing edge may be one or more perimetral fasteners 31 disposed on edge 32. Fasteners 31 may be operable to flex and securely engage with corresponding perimetral edge portions of portion 58.

Stylus receiver 37 may also be disposed on an upper edge of portion 30. Receiver 37 may be designed to receive stylus 55. Stylus 55 may be a digital stylus in the shape of an elongate member such as a pencil or pen. In this respect, receiver 37 is shown as substantially cylindrical with flexible, separate lips operable to slidably receive and retain mechanism 55. However, receiver 37 may be in any shape or manner including a two-part bendable, flexible receiver operable to securely engage any other control mechanism of device 50 including a mouse, remote control, or the like. Receiver 37 may also be integrally formed with edge 32 or detachable therewith as needed or desired.

Preferably, edge 32 may be defined by extending substantially normal away from the rear support surface 33 and terminating in an inwardly extending lip. The lip may be wider or thicker than the lower portion of edge 32 extending away from the rear support surface 33. In this respect, perimetral edge 32 may be operable to flex outwards when receiving portion 58 while also being capable of securely retaining device 58 once assembled under the described lip and edge 32.

Portion 30 may also include optional optical system cutout 31 and/or actuator surfaces or cutouts positioned with edge 32. Cutout 31 may be formed by being trimmed or cut from edge 32 by the end-user according to particular device 50. Edge 32 in turn may be formed with pre-etched portions operable to be trimmed or modified as needed by the end-user. Cutout 21 may also include corresponding hingeable covering surfaces or detachable covers that can be easily moved as needed or required to further shield corresponding optical system 56 of device 50 and/or related actuators positioned along the corresponding perimeter of device 50. In this regard, portion 30 is a composite portion that advantageously includes a hybrid rigid rear surface 33 in combination with resilient protection of edges 32 to portion 58 across a range of operating environments.

Portion 20 may be constructed from substantially rigid material. Portion 20 may include a perimetral edge 22. Portion 20 may include a plurality of corners 34 with reinforced material for protecting corners of portion 54. Edge 22 may extend substantially normal away from the rear support surface 23 and terminating in an inwardly extending lip. The lip may be discontinuous along lateral edges and the leading edge so as to permit flexing of the rigid portion 20 as well securely fasten with corresponding fasteners of portion 30 in a closed position. For example, the leading edge 27 of portion 20 may include a recessed lip that is lower than the remaining lip of edge 22. This is particularly advantageous in inducing a predetermined flex of case 10 when assembling with portion 54 while also maintaining a rigid outer shell of 20 for portion 54 across a plurality of operating environments. Some or all of lateral edges of edge 22 may also be recessed or completely removed adjacent the trailing edge of portion 20. In this respect, perimetral edge 22 may be operable to flex outwards when receiving portion 54 while also being capable of securely retaining device 54 once assembled under the described lip and edge 22. Lip of edge 22 may be wider or thicker than the lower portion of edge 22 extending away from the rear support surface 23.

One or more lateral fastener tabs 36 may be positioned along edge 32 for releasable attachment with corresponding edge 22 of portion 20. Tabs 36 may be constructed from substantially resilient material capable of flexing. Tab 36 may also include a receiver for fastening with corresponding fastener 26 of portion. However, tab 36 is not so limited and instead may include an outward extending fastener capable of securely engaging with tab 26. and/or edge 22 of portion 20.

Figure 5:
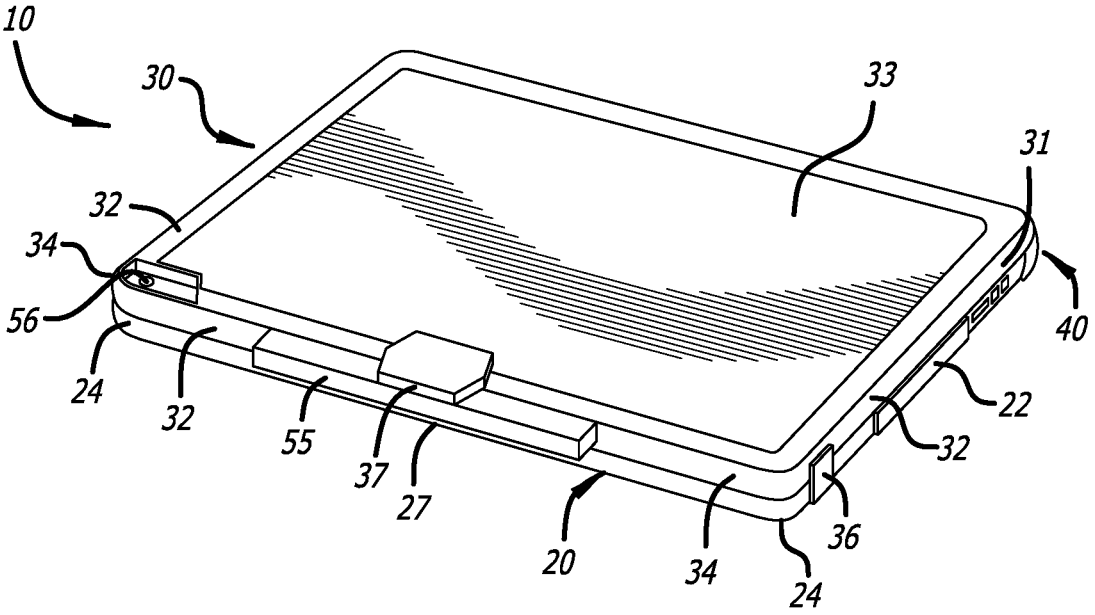
FIG. 5 is a forward perspective of the case and device of FIG. 3 in an assembled state, wherein the case is closed around the computing device.

Turning to FIG. 5, case 10 is depicted in a dosed state so that rear support surface 33 can be readily observed. Surface 33 may be defined by a structural backing plate and be structurally reinforced by one or more upraised portions defined by thicker material relative to non-upraised portions disposed adjacent thereto. Advantageously, the upraised portions with the less thick portions of surface 33 may provide additional rigidity, strength or stiffness to portion 30 of case 10 in a manner that optimizes overall case 10 weight and material costs. FIG. 5 also depicts portions 30 and 20 assembled to each other so that tabs 36 are securely engaged with corresponding fasteners 26.

Figure 6:
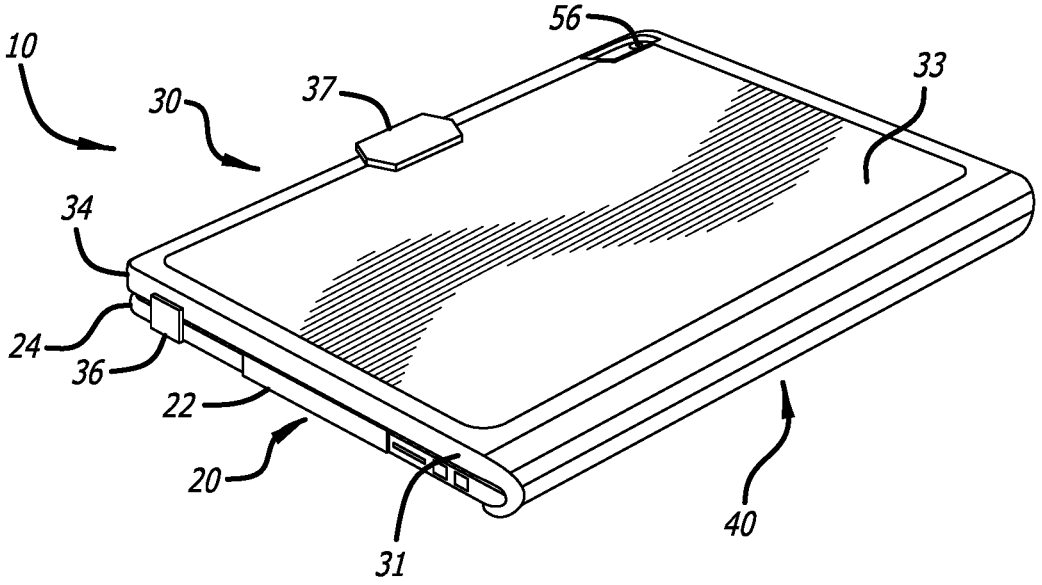
FIG. 6 is a rear perspective of the case and device of FIG. 3 in an assembled state, wherein the case is closed around the computing device.

FIG. 6 depicts a similar view of FIG. 5, wherein case 10 has been rotated to observe portion 40. As can be seen, portion 40 extends between the lateral edges 22 and 32 of portions 20 and 30, respectively. Portion 40 can attach to the trailing edge of portion 20 whereas portions 20 and 30 are connected to each other through hinge 59. In other words, in certain embodiments, portion 20 may be the only feature of case directly attached to portion 40 while portion 30 is loosely assembled therewith only through hinge 59. It is to be understood that case 10 is not so limited, however, and portions 20 and 30 may both directly attach to portion 40.

Figure 7:
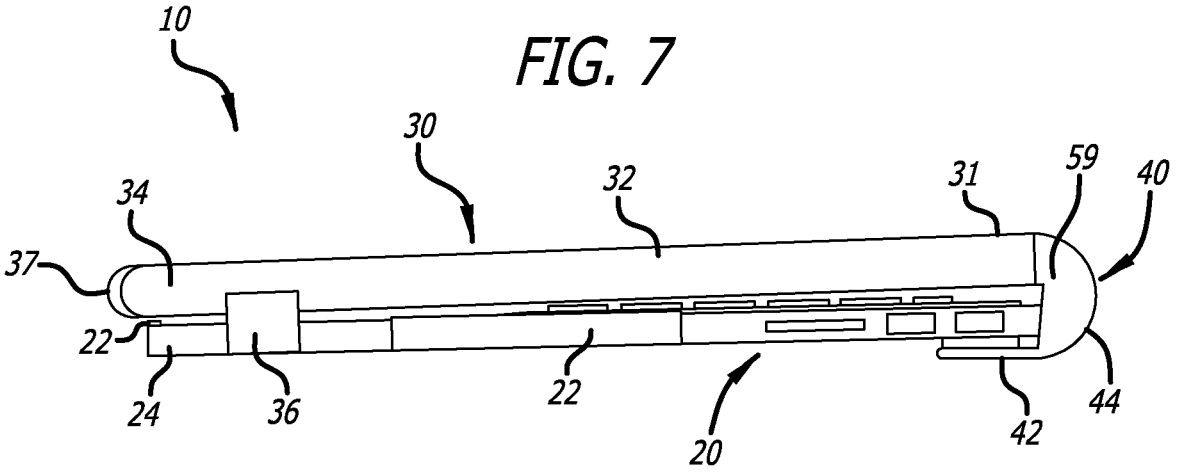
FIG. 7 is a side plan view of the case and computing device of FIGS. 5-6, wherein the case and device are in a closed state.

FIG. 7 depicts a side plan view of the case 10 and device 50 of FIGS. 5-6. As shown, portion 40 can completely receive hinge 59. Portion 40 may include one or more lower fasteners 42 that fasten to the trailing edge of portion 20. Fasteners 42 may be planar and/or parallel with surface 23. Portion 40 may also include an elongate hinge receiving chamber defined by an elongate contoured extruded surface 44. Surface 44 may be substantially hemispherical with one or more grooves or channels of varying thickness. In this regard, surface 44 may be thicker than corresponding fasteners 42 and more resistant to bending. However, thinned out grooves or channels of surface 44 may permit the chamber defined by surface 44 to bend or conform with hinge 59 as hinge 59 rotates between opened and closed positions.

Figure 8:
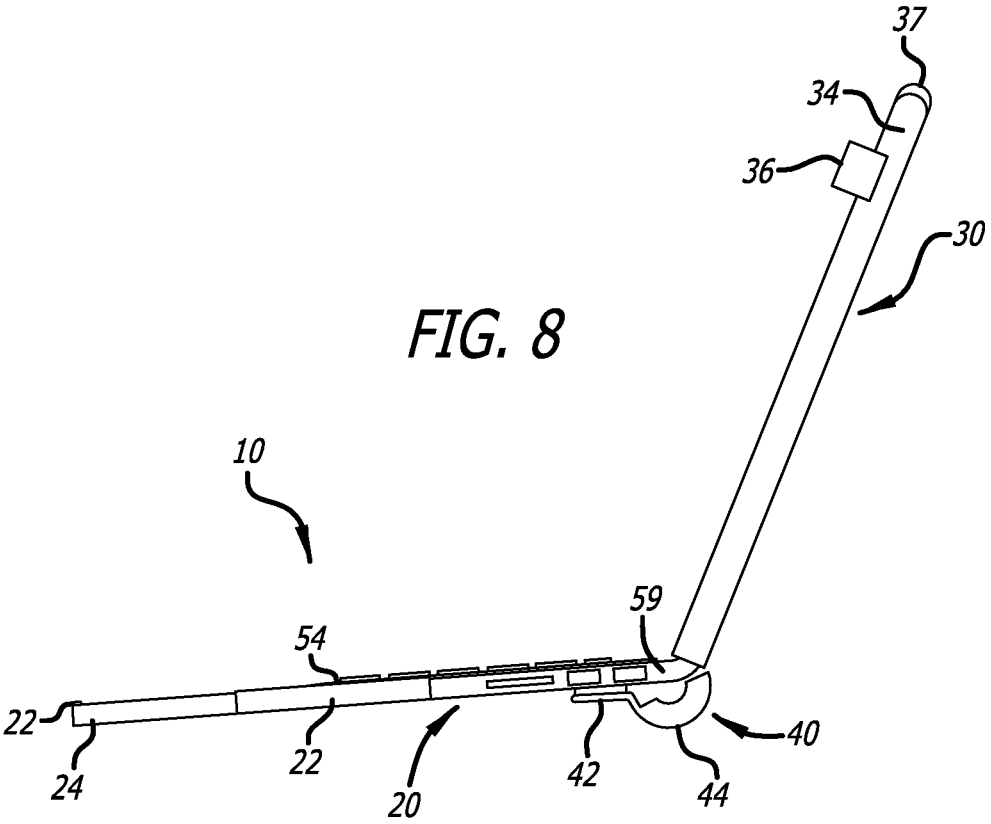
FIG. 8 is a side plan view of the case and computing device of FIGS. 5-6, wherein the case and device are in an opened state.

FIG. 8 depicts a side plan view of the device of FIG. 7 in an opened position, wherein portions 20, 30, and 40 are assembled with each other, As shown, a gap can be included in between an inner surface of portion 40 and hinge 59 that permits hinge 59 to rotate between opened and closed positions. As also shown, portion 30 may not directly attached to portion 20 but instead may be assembled therewith indirectly through hinge 59 being directly connected to portions 54 and 58 (each of which may be directly attached to or separate from respective portions 20 and 30).

Figure 9:
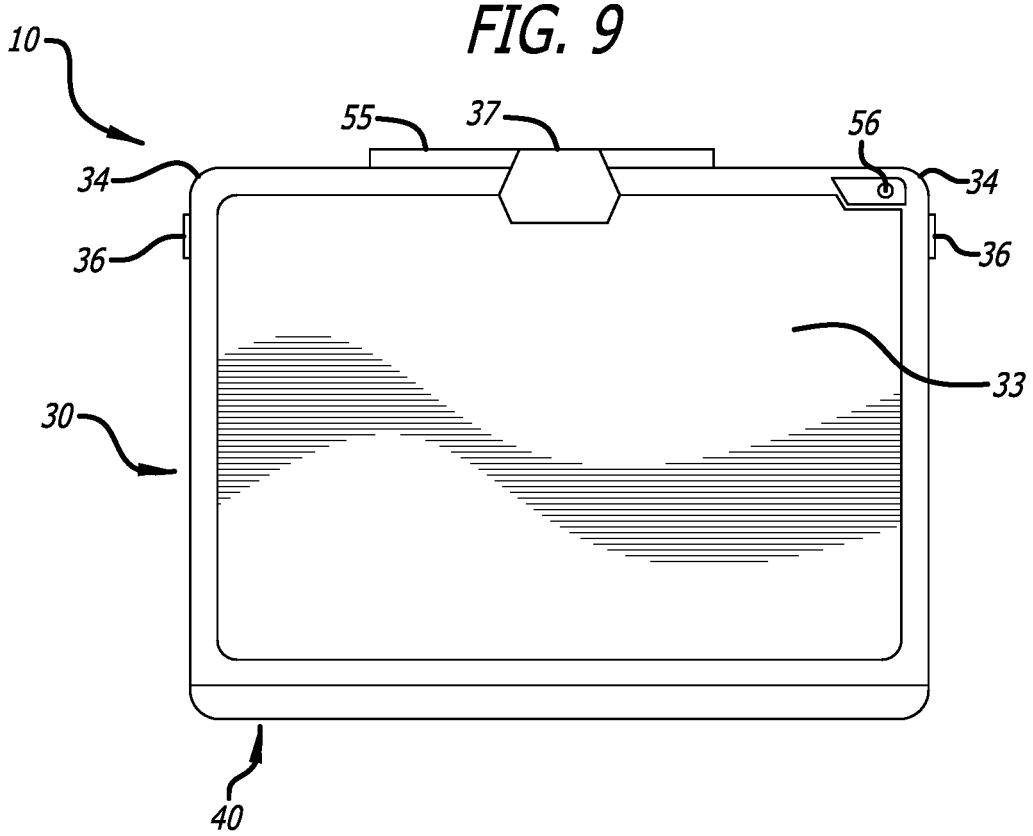
FIG. 9 is a top plan view of the case and computing device of FIGS. 5-6, wherein the case and device are in a closed state.
Figure 10:
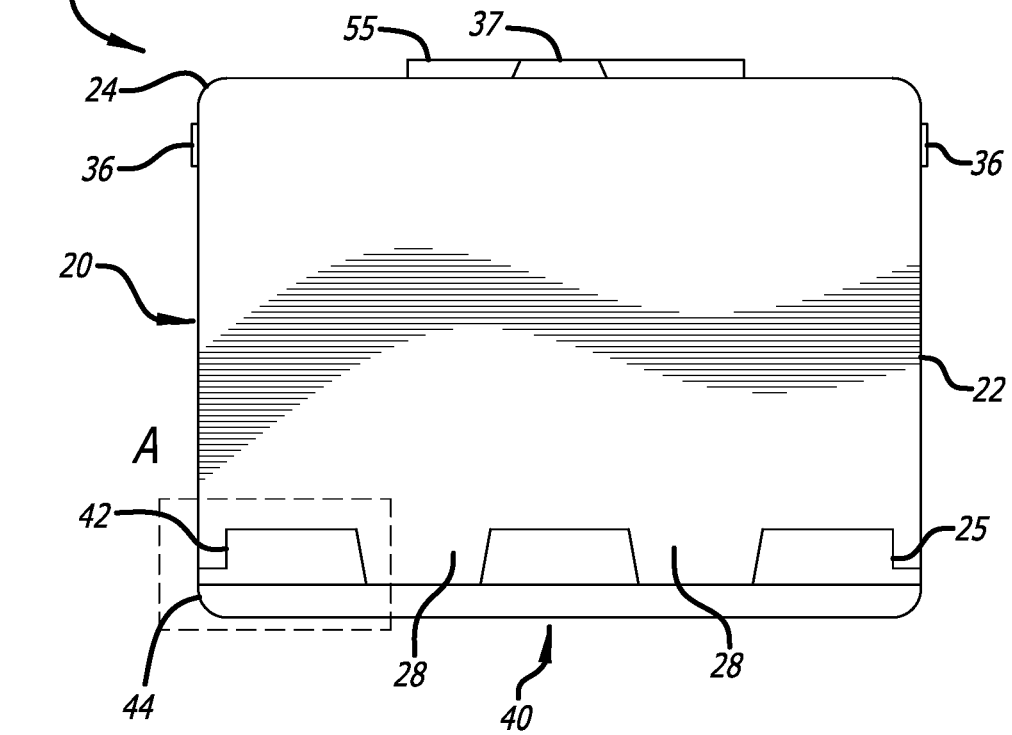
FIG. 10 is a bottom plan view of the case and computing device of FIGS. 5-6, wherein the case and device are in a closed state.

FIG. 9 depicts a top plan view of case 10. As shown, portion 40 is assembled with. portion 20 which is positioned underneath portion 30 in this embodiment. FIG. 10 depicts a bottom plan view of the case 10 in FIG. 9, wherein a plurality of fasteners 42 can be seen fastened to portion 20 along its trailing edge 25. The attachment area of portion 40 associated with 42 may be completely removed or thinned out which renders portion 20 capable of additional flexing or twisting. Fasteners 42 may be separated by one or more spaces 28 along the trailing edge.

Figure 11:
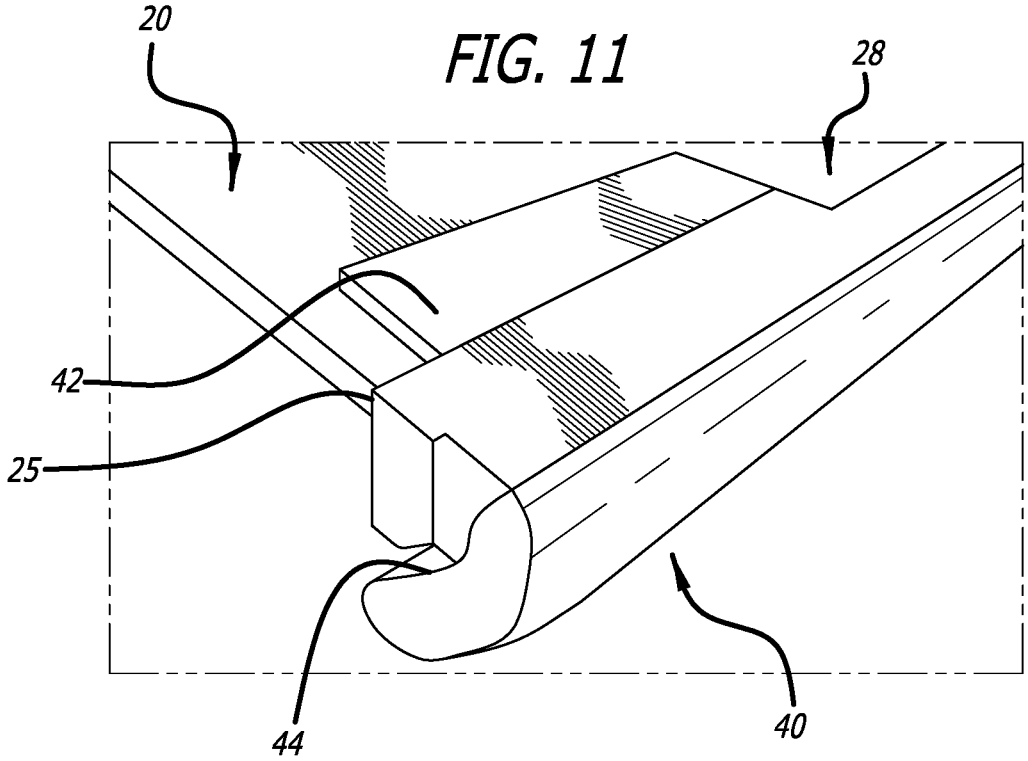
FIG. 11 is a close-up forward perspective view of section A of FIG. 10.
Figure 12:
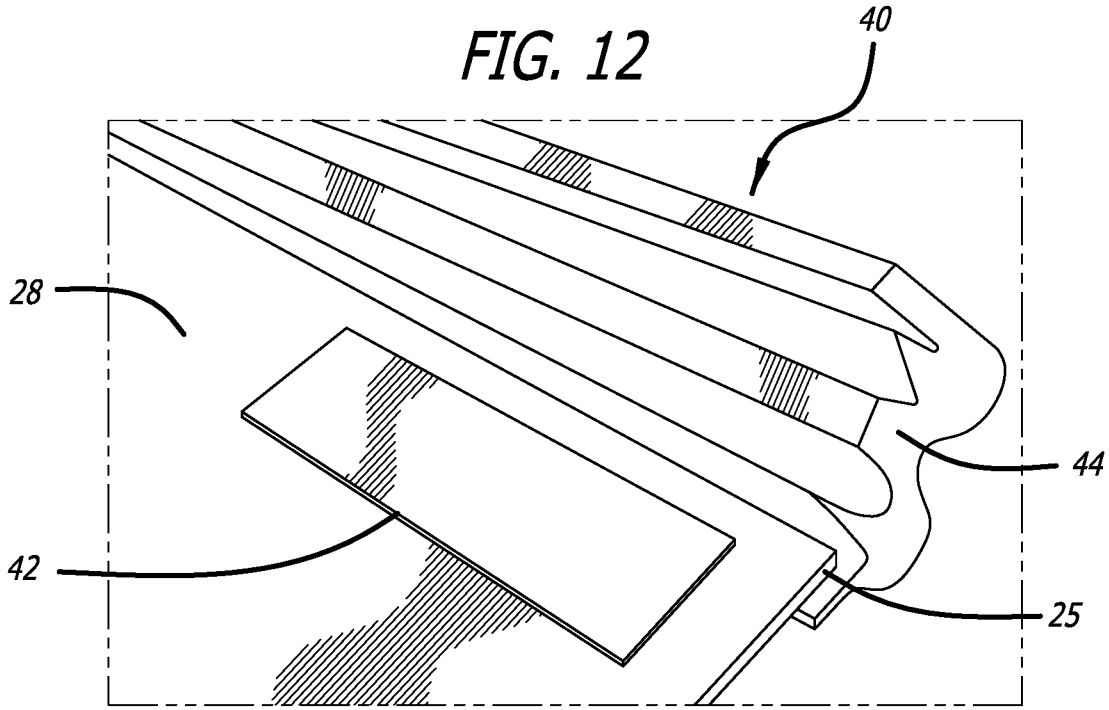
FIG. 12 is a close-up rear perspective view of section A of FIG. 10.

FIG. 11 is a close-up forward perspective view of section A of FIG. 10 and FIG. 12 is a close-up rear perspective view of section A of FIG. 10. As can be seen, at trailing edge 25 of portion 20 a recess or cutout has been positioned to receive fastener 42. In some embodiments, fastener 42 may be fastened only to the outer surface of portion 20, only the inner surface of portion 20, or both the inner and outer surfaces of portion 20. As can be seen, surface 44 can include a plurality of grooves or channels of varying thickness that collectively form a chamber for receiving hinge 59.

Figure 13:
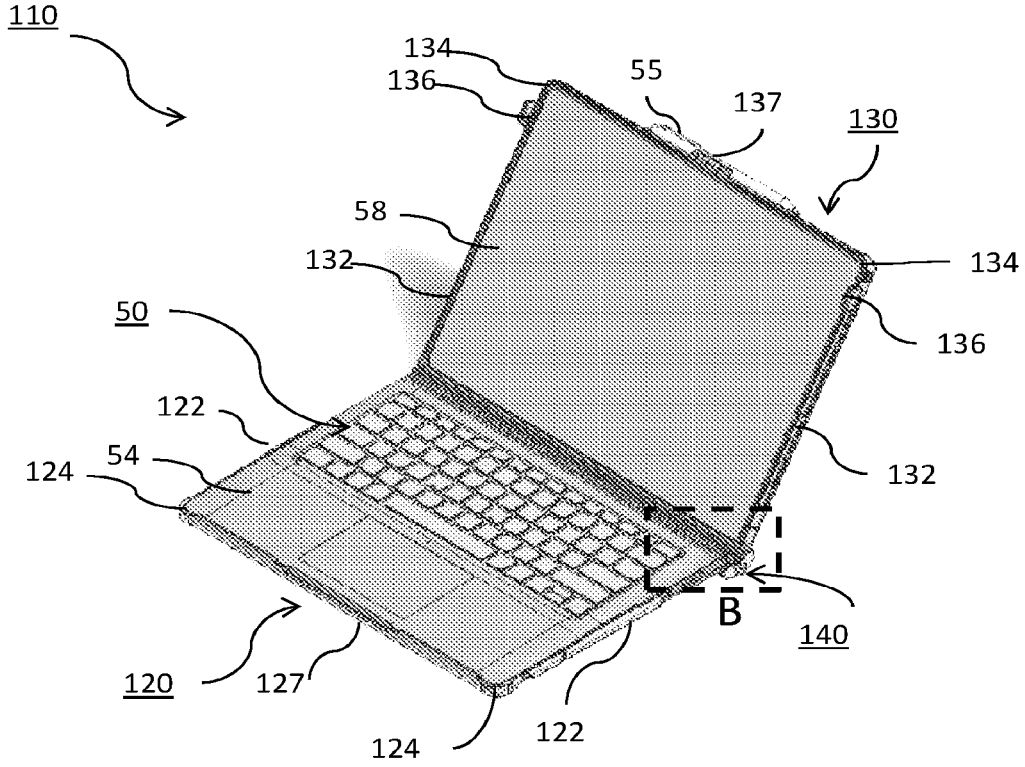
FIG. 13 is a forward perspective view of an exemplary view of another embodiment of the protective case for a computing device, wherein the case and computing device are in an opened state.
Figure 14:
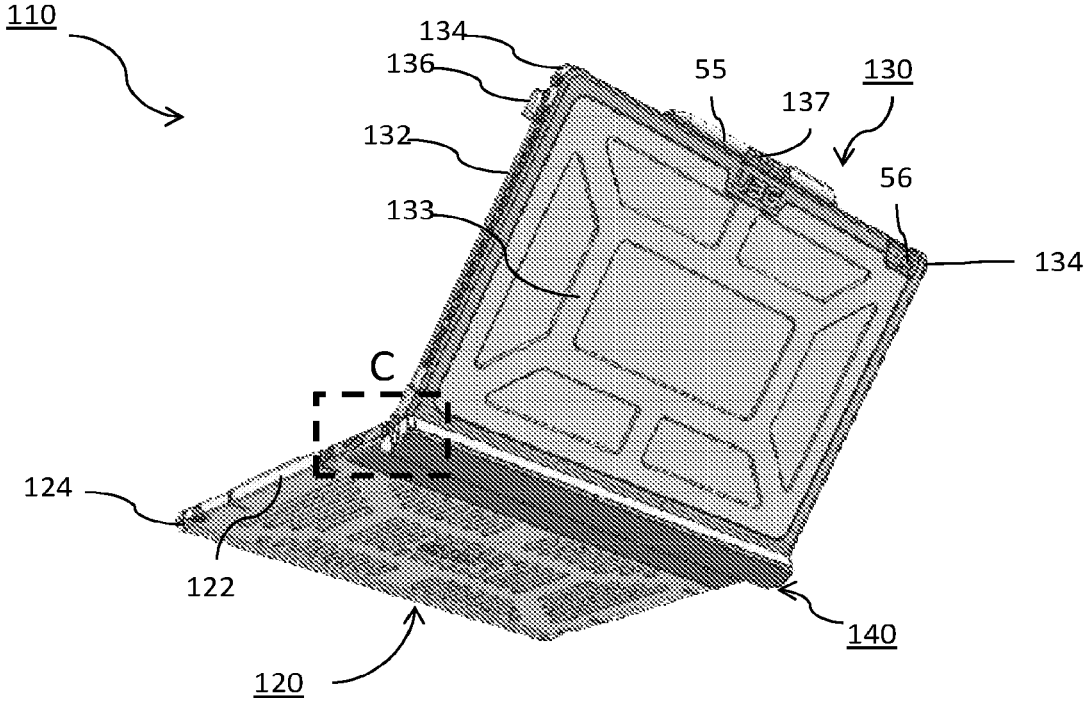
FIG. 14 is rear perspective view the case of FIG. 13.

FIG. 13 is a forward perspective view of another embodiment of the protective case 110 for computing device 50. It is to be understood that features of case 110 with the same reference numerals as case 10 are intended to carry substantially similar function and structure as those previously described in case 10. However, portion 40 differs from portion 140 as discussed more particularly below. FIG. 14 is rear perspective view of case 110 and device 50 shown in FIG. 13. As shown in FIG. 14, portion 140 includes a fastener 142 that extends from surface 144 and attaches to trailing edge 125 of portion 30. Portion 120 in this respect does not include spaces 28. Instead, edge 125 may include a recessed portion that forms a flange onto which fastener 142 may be fastened. Fastener 142 may be a Wabash hinge formed from a plurality of or a single unitary surface that extends between lateral edges 122 or may be constructed from a plurality of separate layers or laminates. In one embodiment, an outer layer of fastener 142 may be grip inducing for enhanced handling by user and stability of case 110 and device 50 when seated and assembled onto a surface for use.

Figure 15:
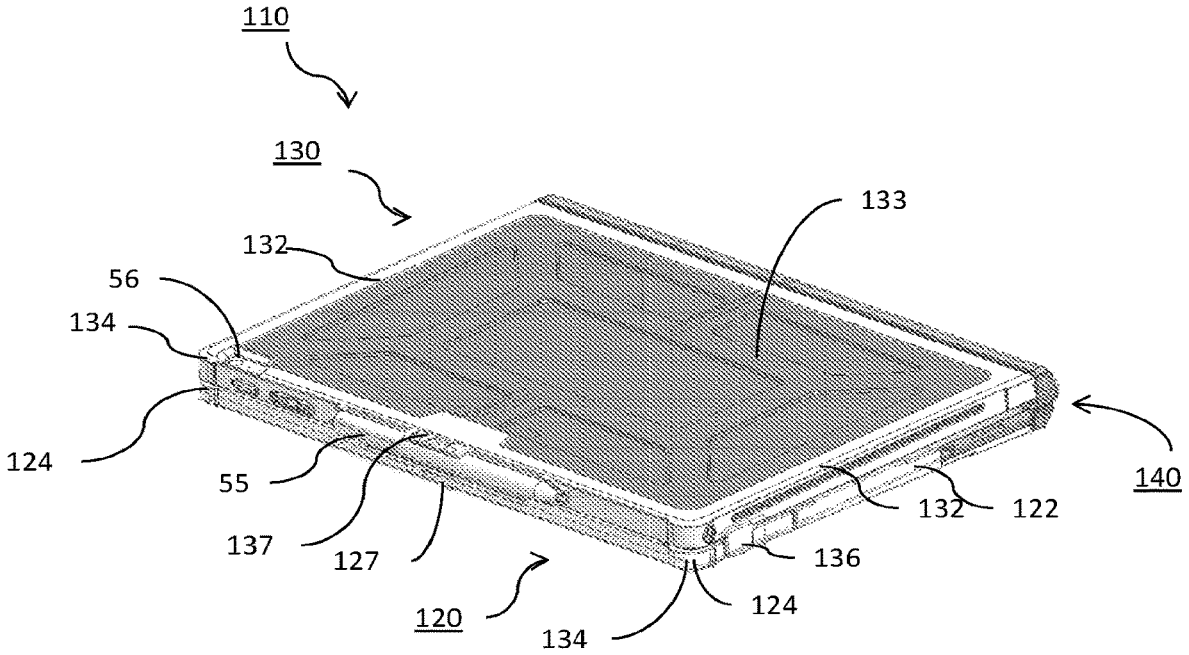
FIG. 15 is a forward perspective of the case and device of FIG. 13 in an assembled state, wherein the case is closed around the computing device.
Figure 16:
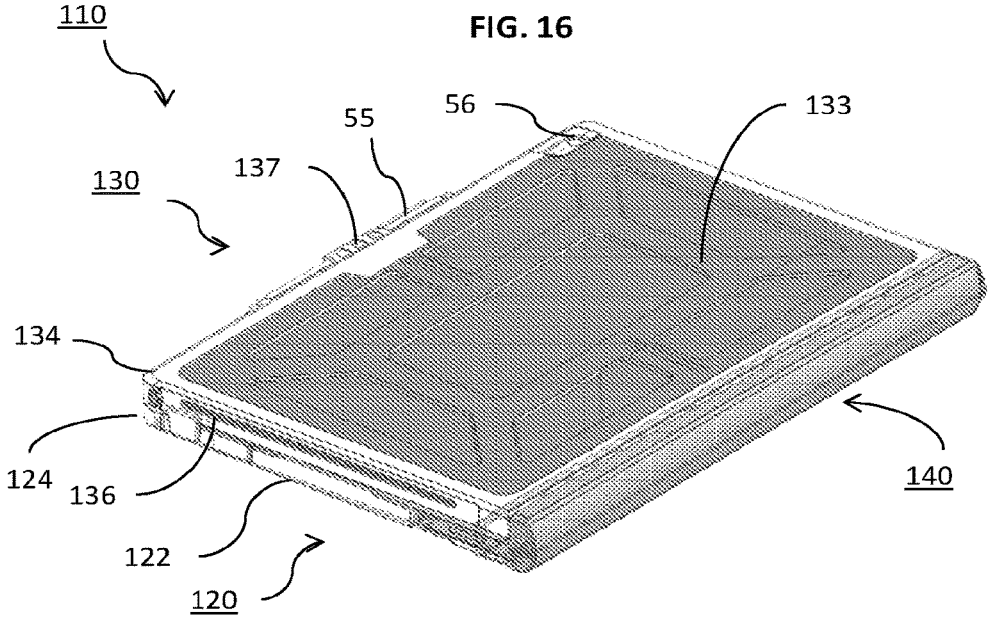
FIG. 16 is a rear perspective of the case and device of FIG. 15 in an assembled state, wherein the case is closed around the computing device.

FIG. 15 is a forward perspective of case 110 and device 50 in an assembled state, wherein the case 110 is closed around the computing device. FIG. 16 is a rear perspective of case 110 and device 50 of FIG. 15 in an assembled state, wherein the case 110 is closed around the computing device 50. As can be seen, surface 144 may include a hinge receiving chamber formed from a unitary contour as opposed to the plurality of grooves or channels of surface 44.

Figure 17:
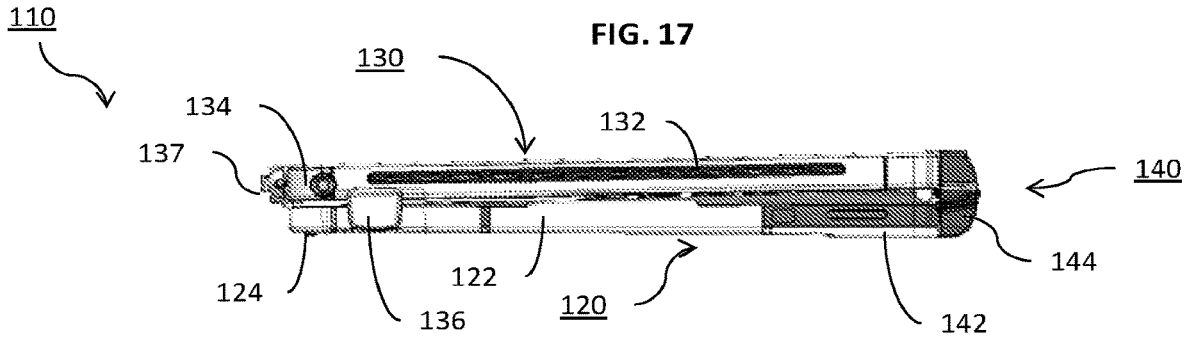
FIG. 17 is a side plan view of the case and computing device of FIGS. 15-16, wherein the case and device are in a closed state.

FIG. 17 is a side plan view of case 110 and device 50 in a closed state. As can be seen, fastener 136 extends from edge 132 of portion 130 to fasten with portion 120. On the opposite end, portion 140 completely houses hinge 59. Fastener 142 may be substantially planar with outer surface 123 of portion 120. As can be seen in FIG. 17, when portions 130 and/or 120 are securely engaged, a protective shell can be formed around device 50.

Figure 18:
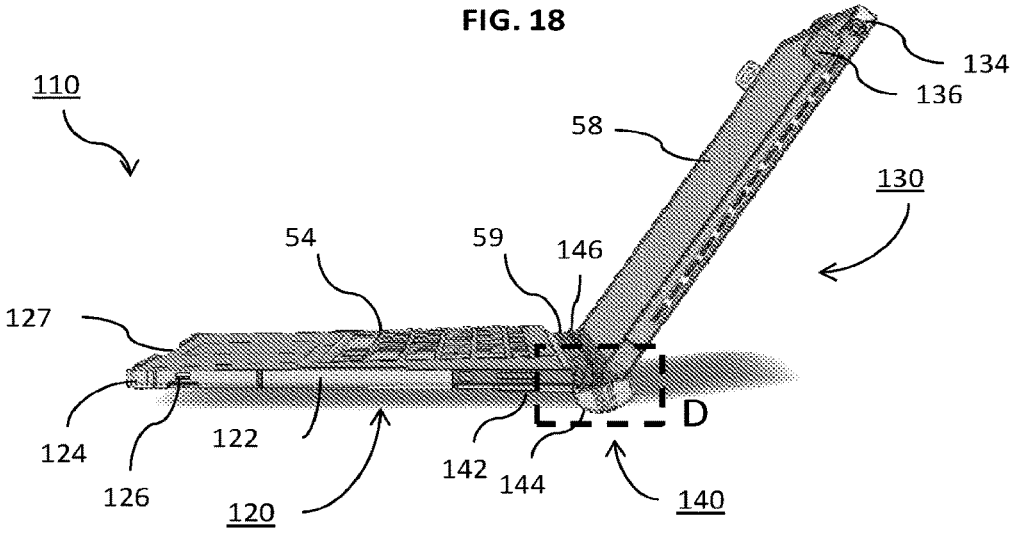
FIG. 18 is a side perspective view of the case and computing device of FIGS. 15-16, wherein the case and device are in an opened state.

FIG. 18 is a side perspective view of case 110 assembled with device 50 in an opened state. The leading edge of portion 120 may include recessed lip 127 that communicates with receiver 137 of portion 137. Reinforced corner 124 may be disposed on edge 122 adjacent fastener 126. As shown, fastener 126 may include an outwardly extended lip from edge 122 operable to securely engage with fastener 136 of portion 130. Fastener 126 may be constructed from substantially rigid material and fastener 136 may be substantially resilient so as to flexibly engage with the other when securely engaging.

Portion 140 may include a retaining band 146 operably to securely and adjustably maintain hinge 59 engaged with portion 140. This is seen more clearly in FIG. 19 wherein a side perspective of case 110 in an opened state without device 50. Band 146 can be seen extended from lateral ends of surface 144. Band 146 may be substantially elastic and releasably attached at one or both ends of surface 144. Band 146 may also be fixedly attached at both ends and include a predetermined elasticity so that it can move to a stretch point when hinge 59 is positioned therebelow within surface 144. Optionally, adjacent trailing edge 125 may be a retaining groove 123 operable to engage with portion 54. Adjacent leading edge of portion 120 may also be a groove 129 to engage with portion 54. Grooves 123 and 129 facilitate proper positioning of portion 54 when being secured with portion 120. Optionally, band 146 can be positioned anywhere along surface 144 and may further include a tension adjustment mechanism so that the end-user can, for example, adjust the corresponding tension and engagement between device 50 and band 146.

Figure 19:
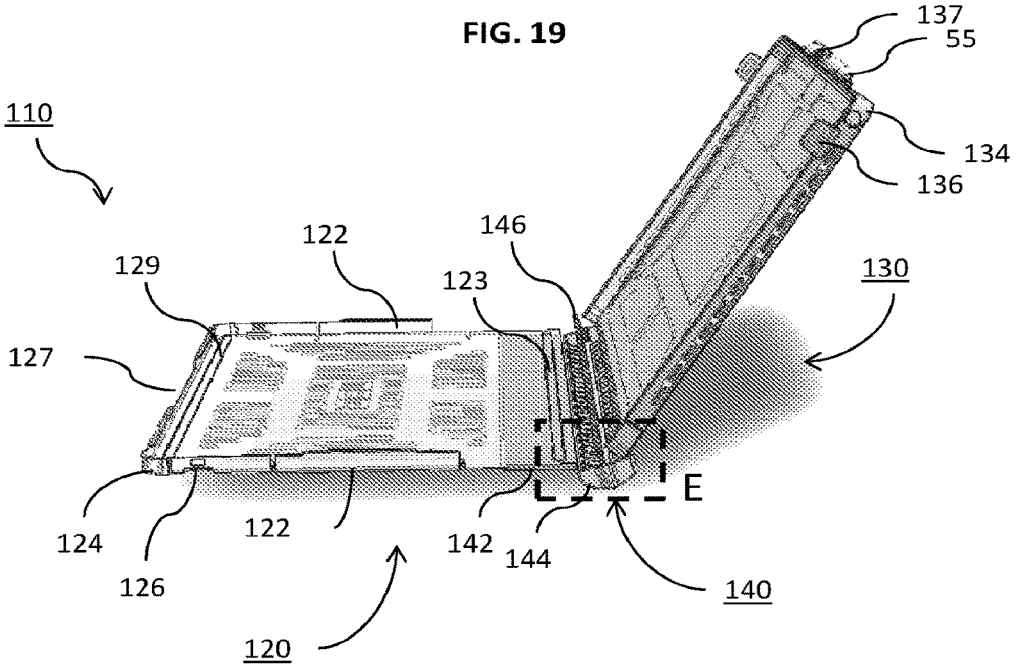
FIG. 19 is a side perspective view of the case of FIGS. 15-16 without the computing device, wherein the case is in an opened state.
Figure 20:
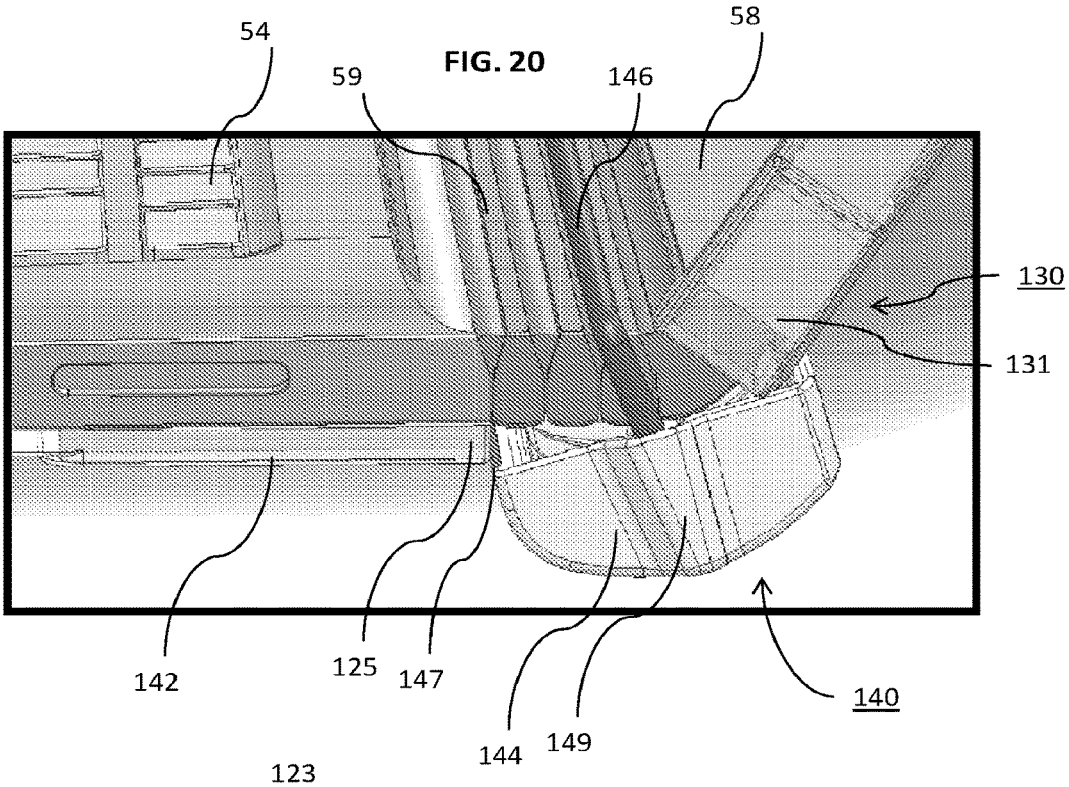
FIG. 20 is a close-up perspective view of section B of FIG. 13.
Figure 21:
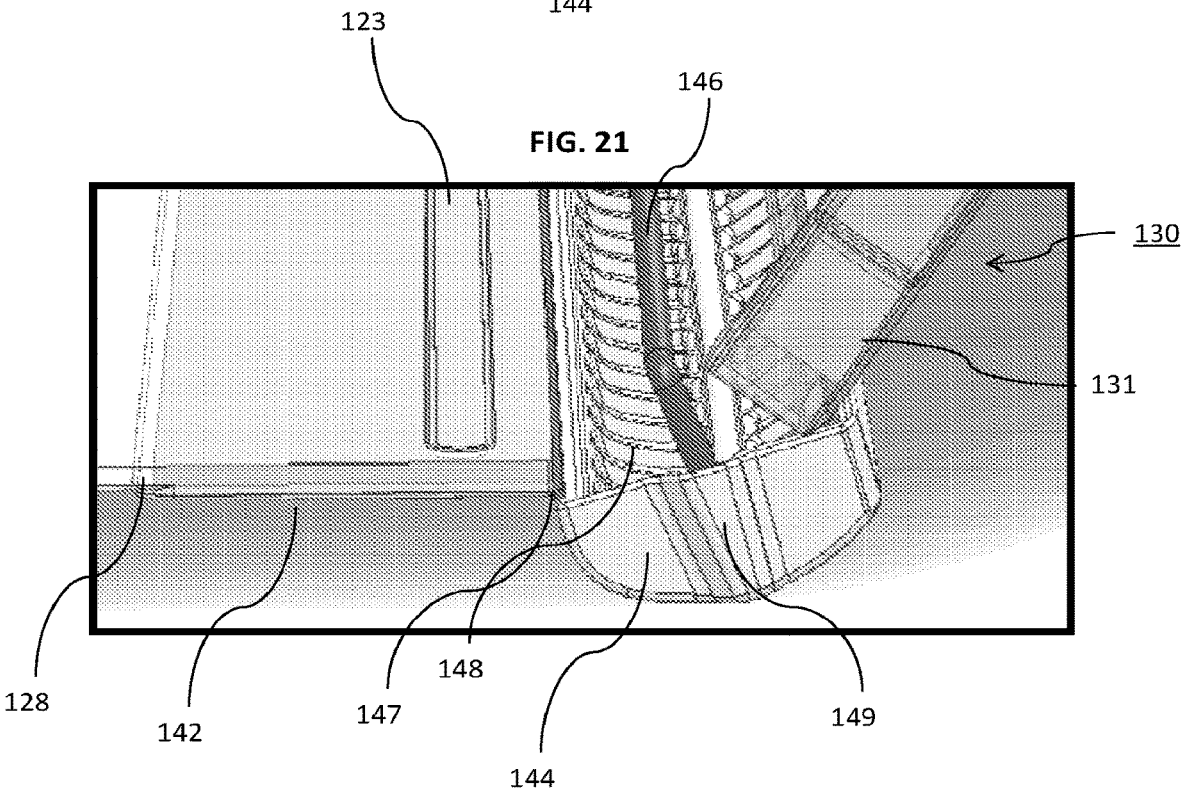
FIG. 21 is a close-up perspective view of section D of FIG. 18.

FIG. 20 is a close-up perspective view of section B of FIG. 13. As shown, portion 140 includes surface 144 and fastener 142. Fastener 142 is oriented planar with trailing edge 125. Fastener 142 may be fastened thereon by any number of techniques include use of one or more mechanical fasteners, an adhesive, sonic welding, or the like. Portion 140 may also include a rotational axis 147 consistent with a Wabash hinge that is defined between fastener 142 and a shared edge of surface 144. In this respect, fastener 142 may be operable to pivot between opened and closed states. Each lateral end 149 of surface 144 may include a bend or contoured portion to receive respective ends of band 146. Fastener 131 of portion 130 can also be seen securely engaged with corresponding corner of portion 58 while portion 58 in turn is securely engaged with hinge 59. FIG. 21 is a close-up perspective view of section D of FIG. 19, wherein device 50 has been removed to observe constituent features of case 110. Portion 140 can be seen including one or more support structures 148 such as bulkheads that run laterally or normal relative to band 146.

Figure 22:
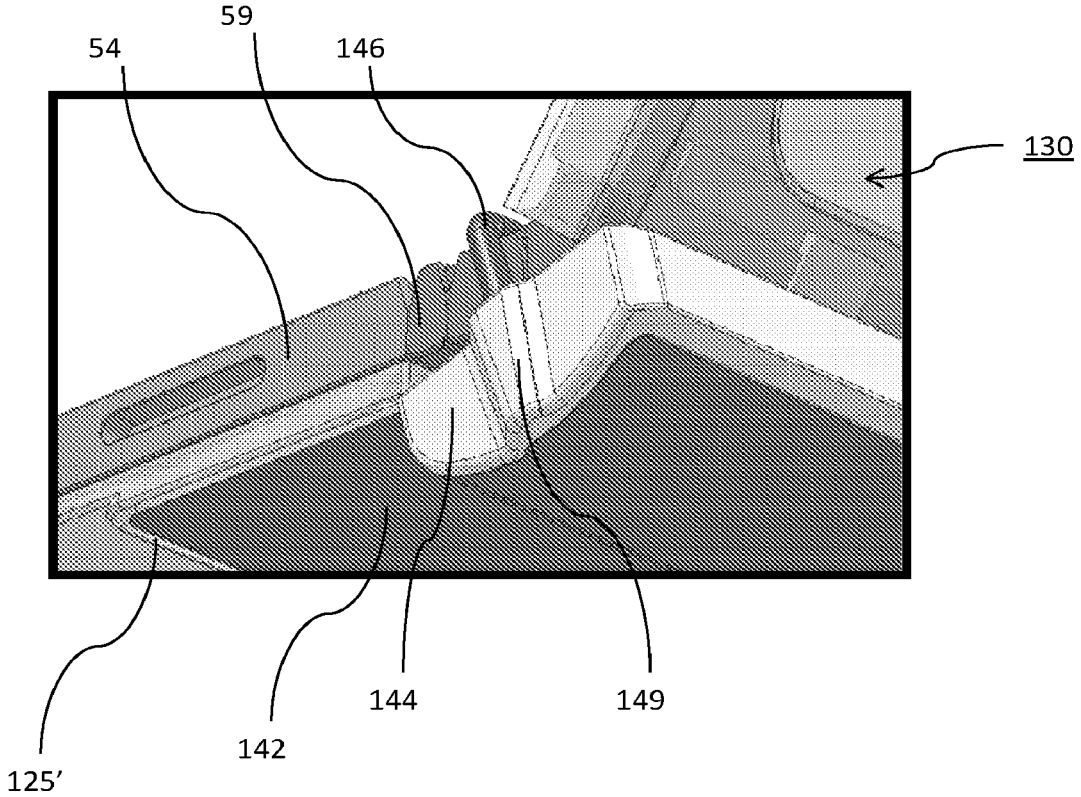
FIG. 22 is a close-up perspective view of section C of FIG. 14.
Figure 23:
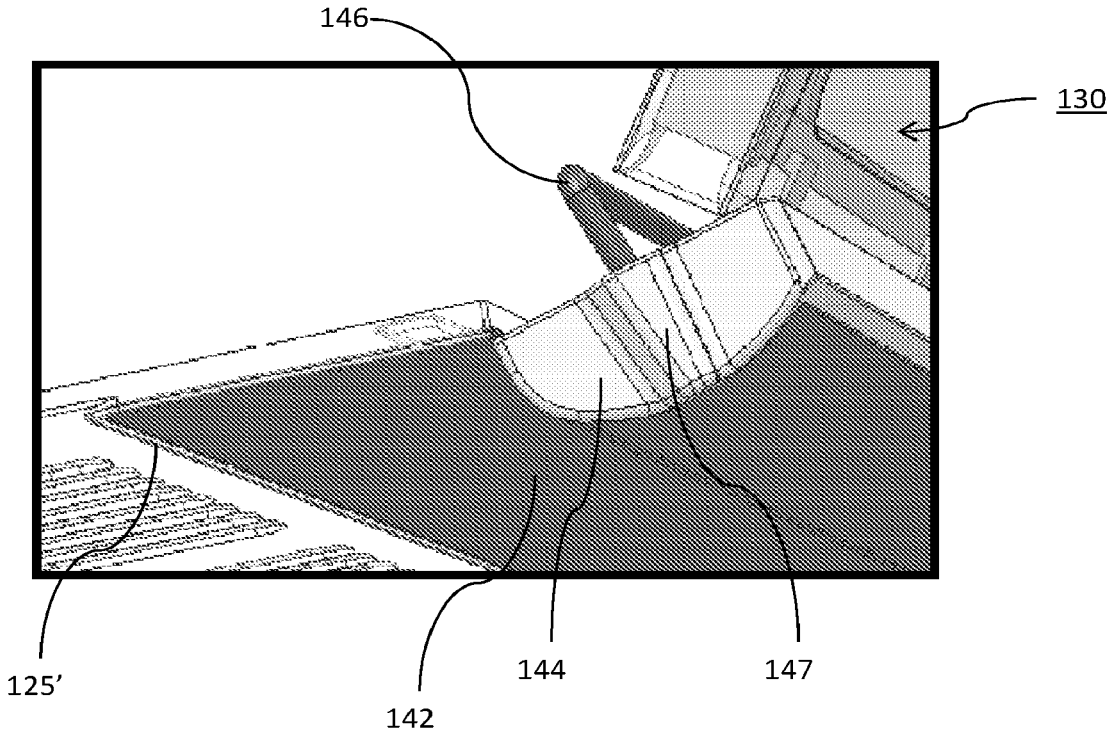
FIG. 23 is a close-up perspective view of section C of FIG. 14, wherein the computing device has been removed.

FIG. 22 is a close-up perspective view of section C of FIG. 14. In particular, fastener 142 can be seen being substantially planar with and fastened to leading edge 125 of portion 120. In this embodiment, leading edge 125 may include a recessed lip 125' so that when fastened, fastener 142 and outer surface 123 are substantially planar with each other. Lateral end 149 can also be seen outwardly extended to provide a space or gap into which band 146 may be positioned for secure engagement with surface 144 and hinge 59 during use. FIG. 23 is a close-up perspective view of section C of FIG. 14, wherein device 50 has been removed to more clearly show constituent features of case 110.

Figure 24:
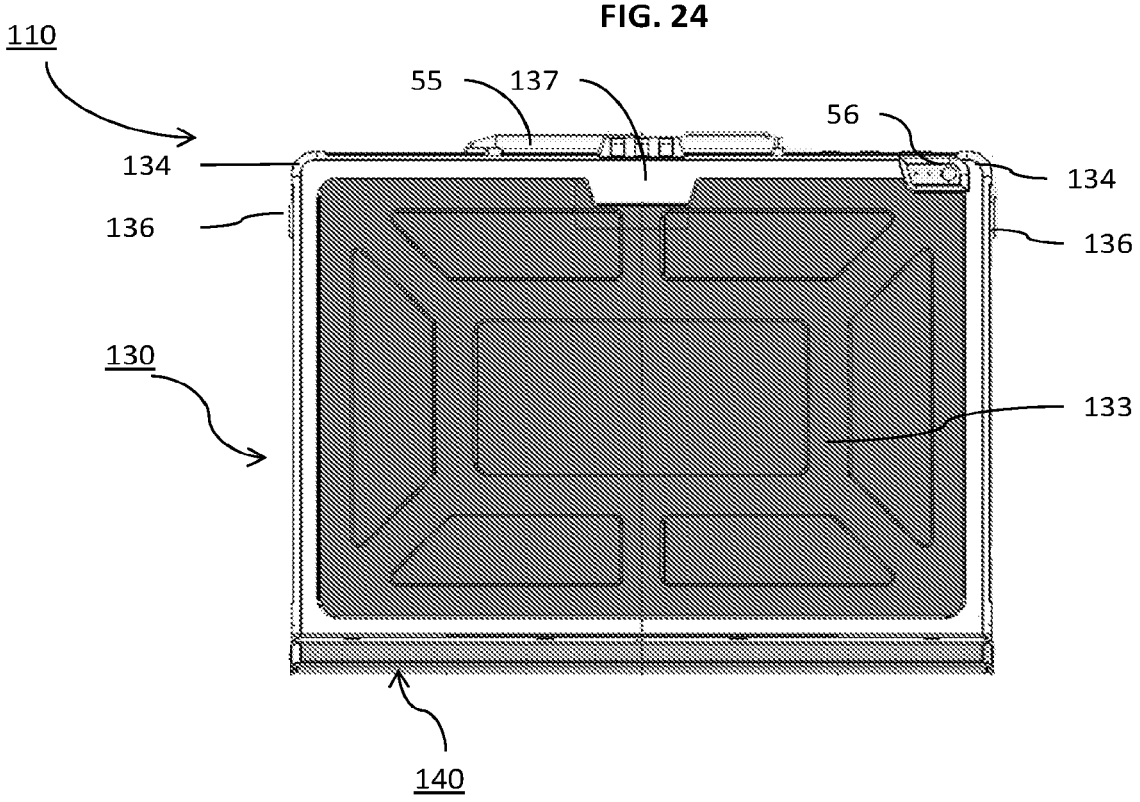
FIG. 24 is a top plan view of the case and computing device of FIGS. 13-23, wherein the case and device are in a closed state.
Figure 25:
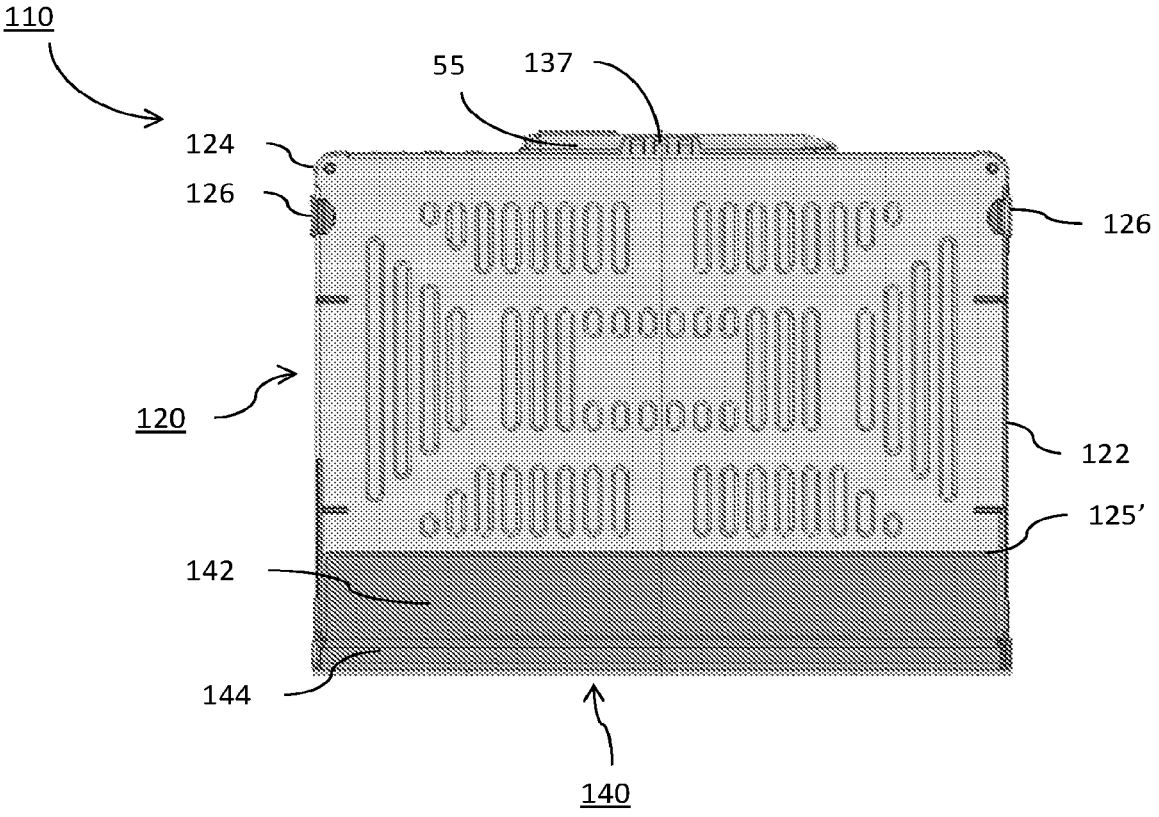
FIG. 25 is a bottom plan view of the case and computing device of FIGS. 13-23, wherein the case and device are in a closed state.

FIG. 24 is a top plan view of case 110 and device 50 and FIG. 25 is a bottom plan view of case 110 and device 50, each view being in a closed state whereby a protective shell has been formed by case 110 about device 50.

Figure 26:
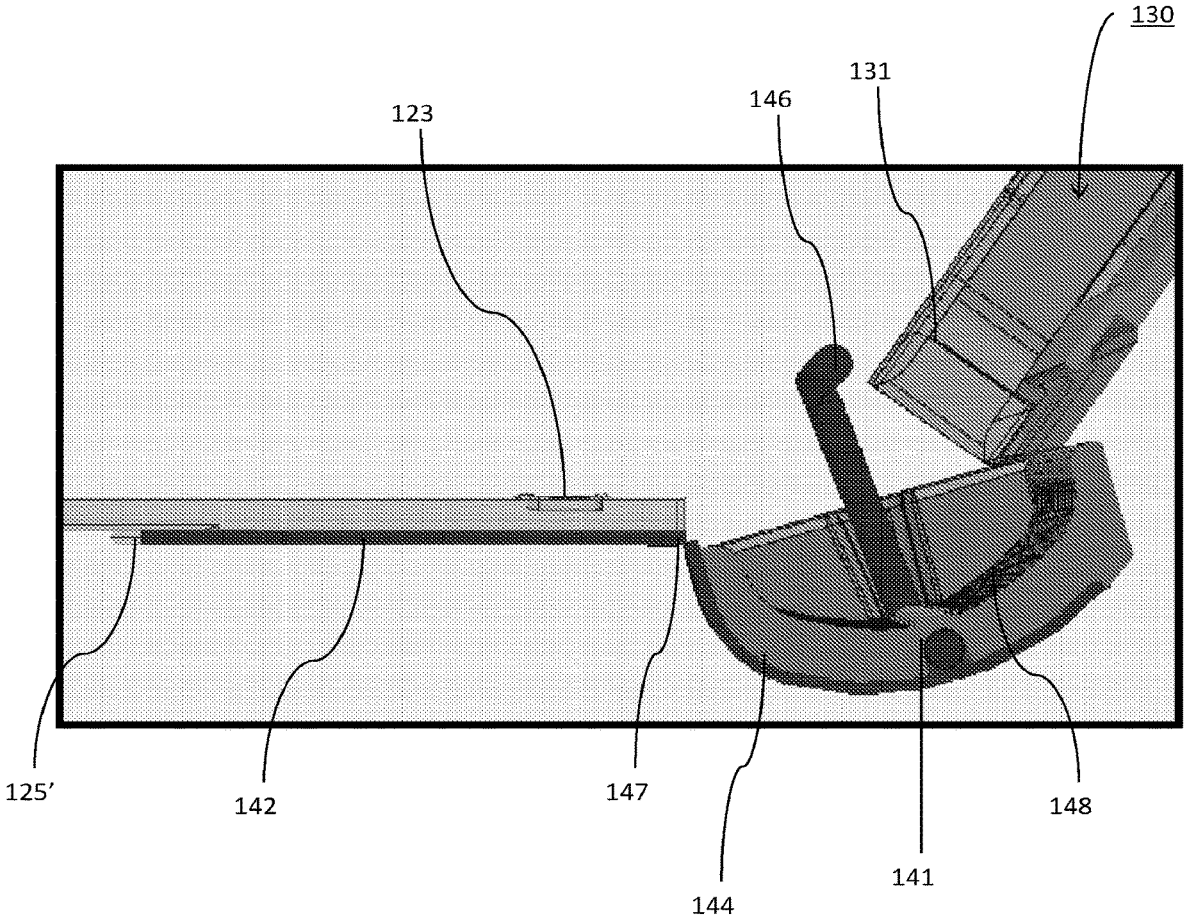
FIG. 26 is a close up side plan cross-sectional view along center line of the case in FIG. 19.

FIG. 26 is a close up side plan cross-sectional view along center line of case 110 in FIG. 19. Surface 144 may be generally hemispherical or semi-cylindrical to form a chamber into which hinge 59 may be positioned. Surface 144 may also include an outer laminate that is grip inducing and/or softer relative to the inner, substantially rigid material of structures 148. Between the outer laminate and the inner rigid material, a void 141 may be provided for receiving band 146, Band 146 may therefore be detachably inserted through void 141 between lateral ends 149 while extending over hinge 59 when device 50 is securely assembled therewith.

In certain embodiments, the outer laminate of surface 144 may be formed with fastener 142. Because the outer laminate may be substantially flexible, a natural pivot may be formed along axis 147 when fastener 142 and outer laminate of surface 144 are fastened and properly positioned with portions 120 and 140. As can also be seen, lip 125' does not have to be recessed. Instead, lip 125' can be raised from surface 123 to coincide with the corresponding thickness of fastener 142.

Figure 27:
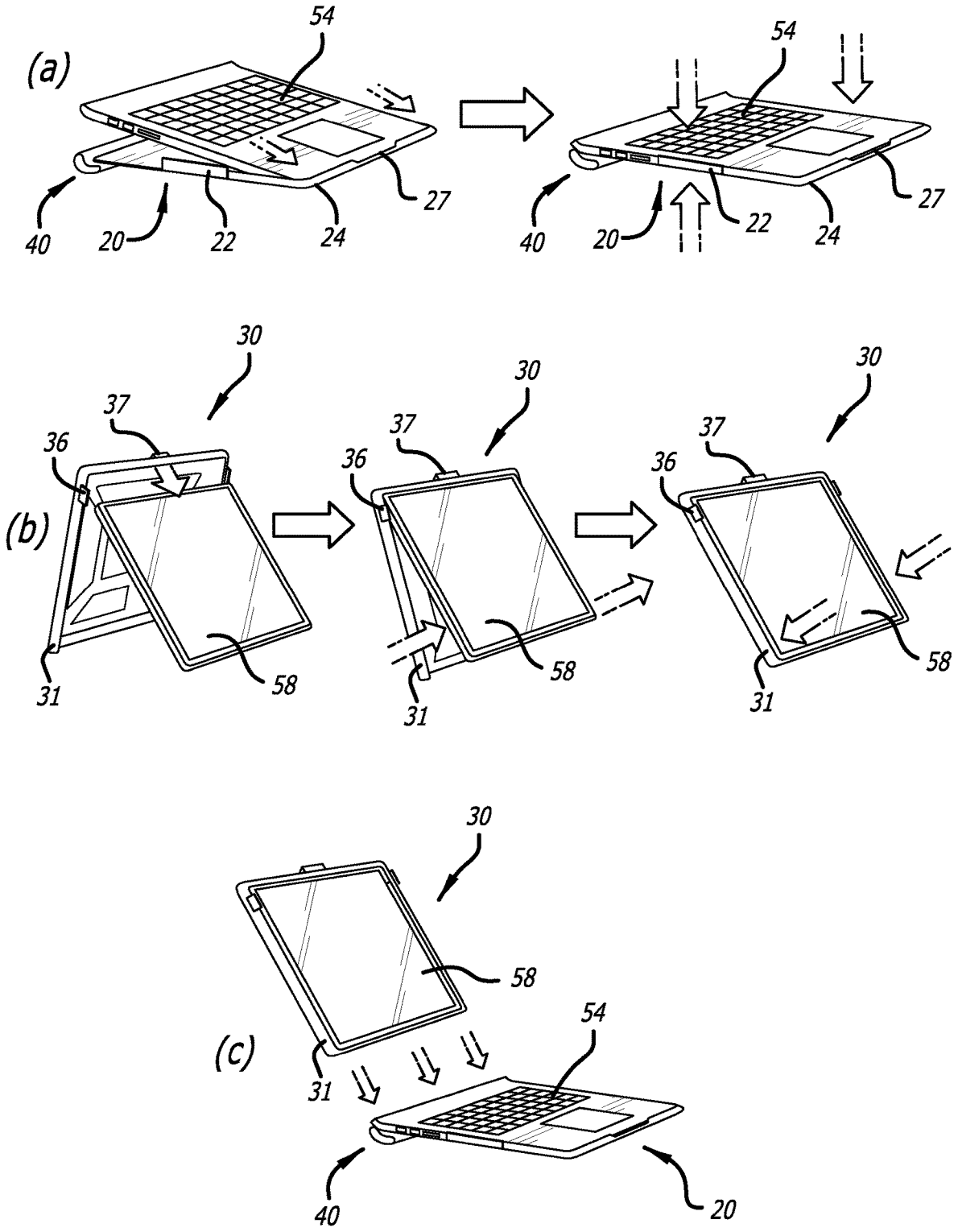
FIG. 27 depicts an exemplary method of installing one of the herein disclosed cases with an exemplary computing device.

In other embodiments, an exemplary method of installing one of the herein disclosed cases 10/110 with device 50 is disclosed, as depicted in FIG. 27. In step (a), the leading edge of portion 54 can be attached with one or more perimetral fasteners 22/122. The leading edge of portion 54 may first be attached and then the lateral edges of portion 54 may then be fastened with corresponding fasteners 22/122. In step (b), the upper edge of portion 58 can be attached with one or more perimetral fasteners 32/132 along the corresponding upper edge of portion 30/130. The upper edge of portion 58 may first be attached and then the lateral edges of portion 58 may then be fastened with corresponding fasteners 32/132. Portions 54 and 58 may each be aligned substantially planar with respective rear surfaces 22/122 and 33/133 upon being attached therewith respective inwardly extended lips and/or fasteners. In step (c), hinge 59 may be positioned in hinge cover portion 40/140 that is attached to portion 20/120 and then portions 54 and 58 may be assembled with each other through hinge 59. As previously discussed, portion 40/140 may have a rigid elongate hemispheric chamber in which hinge 59 can be movable between a plurality of opened and closed positions, In a closed state, a protective shell can be formed about device 50 between portions 20/120 and 30/130 when joined at portion 40/140 and one or more of perimetral fasteners of the portions 20/120 and 30/130 opposite portion 40/140 in the closed position.

Figure 28:
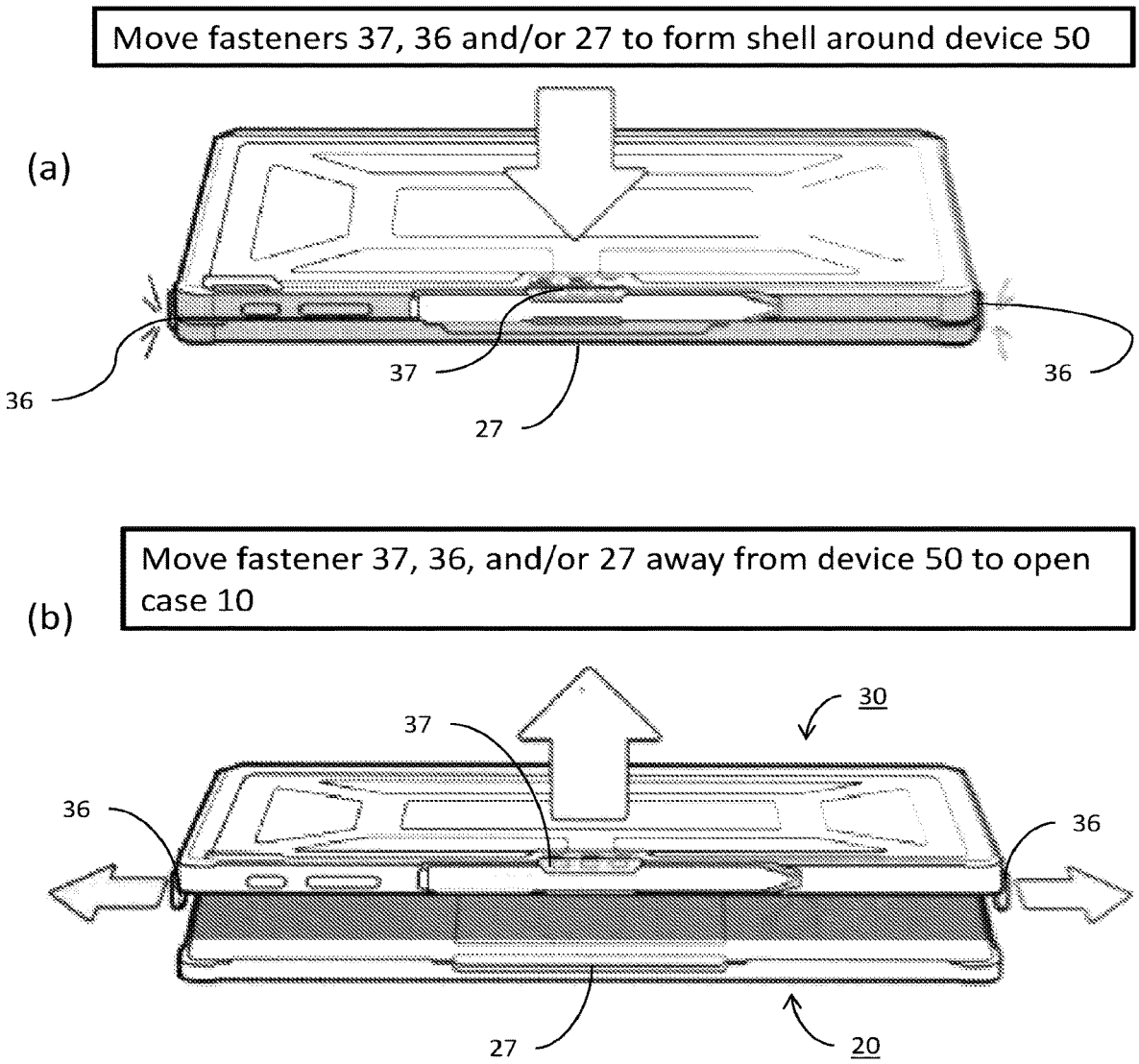
FIG. 28 depicts an exemplary method of forming a protective shell for an exemplary computing device using one of the herein disclosed cases.

FIG. 28 depicts another exemplary method of forming a protective shell about device 50 using one of the herein disclosed cases. As can be seen, in step (a), fastener 37 and/or 27 of respective portions 30 and 20 can be moved towards the other to form the protective shell around device 50. For example, fastener 37 may include a flexible, inwardly extended lip that can securely engaged with fastener 27 and/or a bottom surface of portion 54, when portion 54 is securely engaged with portion 20. Separately, or additionally, fasteners 36 may be securely engaged with corresponding fasteners 26 of portion 20 to securely engage portions 20 and 30 with the other to form the protective shell about device 50. In step (b), case 10 may be moved to one of a plurality of opened states by moving fastener 37 away from portion 20. Separately, or additionally, fasteners 36 may be disengaged with corresponding fasteners 26 of portion 20 by being moved away therefrom so that portions 20 and 30 can freely rotate about hinge 59 to one of a plurality of opened states.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention is claimed as follows:

1. A case comprising:

a first portion configured to protect a first portion of a mobile device;

a second portion configured to protect a second portion of the mobile device spaced apart from the first portion of the mobile device, wherein the first portion of the mobile device and the second portion of the mobile device are connected to each other through a multi-pivot hinge rotatable about at least one axis defined between the first portion of the mobile device and the second portion of the mobile device to move the mobile device between an open state and a closed state; and a hinge cover portion defining a rigid elongate hemispheric chamber configured to receive and surround the multi-pivot hinge of the mobile device, wherein the hinge cover portion is integrally connected to the first portion and the second portion, a first edge of the hinge cover portion is connected to an edge of the first portion and a second edge of the hinge cover portion is connected to an edge of the second portion.

2. The case of claim 1, wherein the first portion further comprises:

a resilient portion dimensioned to detachably receive three edges of the first portion of the mobile device; and a rigid portion detachably connected to a rear surface of the first portion of the mobile device, the rigid portion being impact resistant and dimensioned to shield the rear surface of the first portion of the mobile device.

3. The case of claim 2, wherein at least one impact resistant corner is at least partially formed with the resilient portion.

4. The case of claim 1, wherein the second portion further comprises an inner resilient portion coupled to an outer rigid portion that are collectively dimensioned to detachably receive three edges of the second portion of the mobile device.

5. The case of claim 1, wherein:

the rigid elongate hemispheric chamber extends between lateral edges of the second portion of the case, the rigid elongate hemispheric chamber is configured to axially align with and receive the multi-pivot hinge of the mobile device; and a gap for moving between the open state and the closed state is formed between the multi-pivot hinge of the mobile device and the rigid elongate hemispheric chamber when the hinge cover portion is secured to the multi-pivot hinge of the mobile device.

6. The case of claim 5, wherein:

the rigid elongate hemispheric chamber comprises a plurality of bulkheads normal to the longitudinal axis of the rigid elongate hemispheric chamber and extending along the rigid elongate hemispheric chamber between the lateral edges of the second portion, the second portion is substantially rigid and the hinge cover portion is resilient, and a recess on a lower surface of the second portion renders flexible the edge of the second portion.

7. The case of claim 1, wherein at least part of the first portion and at least part of the second portion are each formed from an outer grip inducing material.

8. The case of claim 1, wherein the first portion comprises a forward edge fastener defined by an inwardly facing lip configured to detachably secure to three edges of the first portion of the mobile device.

9. The case of claim 8, wherein the second portion comprises a forward edge fastener defined by an inwardly facing lip configured to detachably secure to three edges of the second portion of the mobile device.

10. The case of claim 1, wherein:

an axis of rotation of the hinge cover portion is coextensive to a hinge axis of the multi-pivot hinge of the mobile device; and the multi-pivot hinge is an armadillo hinge assembly.

11. The case of claim 1, wherein when the first portion provides impact resistance to the first portion of the mobile device independent of the second portion.

12. The case of claim 1, wherein a protective shell is formed between the first portion and the second portion when the mobile device is in the closed state.

13. A composite case comprising:

a first portion configured to protect a first portion of a mobile device, the first portion comprising an inner resilient portion dimensioned to detachably receive three edges of the first portion of the mobile device, and an outer impact resistant rigid portion;

a second portion configured to protect a second portion of the mobile device spaced apart from the first portion of the mobile device, wherein the first portion of the mobile device and the second portion of the mobile device are connected to each other through a multi-pivot hinge assembly rotatable about at least one axis defined between the first portion of the mobile device and the second portion of the mobile device; and a hinge cover portion integrally coupled to each of the first portion and the second portion, the hinge cover portion defining a chamber having a rigid hemispheric cross section, wherein:

the hinge cover portion is configured to receive and surround at least part of the multi-pivot hinge assembly of the mobile device such that the composite case facilitates moving the mobile device between an open position and a closed position while the composite case is engaged with the mobile device and respectively moved between an open position of the composite case and a closed position of the composite case, the first portion, the hinge cover portion and the second portion form at least part of a protective shell, and a first edge of the hinge cover portion is connected to an edge of the first portion and a second edge of the hinge cover portion is connected to an edge of the second portion.

14. The composite case of claim 13, wherein the second portion comprises an inner resilient portion dimensioned to detachably receive three edges of the second portion of the mobile device, and an outer impact resistant rigid portion.

15. The composite case of claim 13, wherein the hinge cover portion comprises at least one of a resilient portion and an impact resistant rigid portion.

16. The composite case of claim 13, wherein at least part of the first portion and at least part of the second portion are each formed from an outer grip inducing material.

17. The composite case of claim 13, wherein:

an axis of rotation of the hinge cover portion is coextensive to a hinge axis of the multi-pivot hinge assembly of the mobile device; and the multi-pivot hinge assembly comprises an armadillo hinge assembly.

* * * * *